US010316660B2

(12) United States Patent
Burton et al.

(10) Patent No.: US 10,316,660 B2
(45) **Date of Patent: *Jun. 11, 2019**

(54) PICK INCLUDING POLYCRYSTALLINE DIAMOND COMPACT

(71) Applicant: US SYNTHETIC CORPORATION, Orem, UT (US)

(72) Inventors: Regan Leland Burton, Saratoga Springs, UT (US); Andrew E. Dadson, Vinyard, UT (US); Mohammad N. Sani, Bracknell (GB)

(73) Assignee: APERGY BMCS ACQUISITION CORPORATION, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/238,486

(22) Filed: Aug. 16, 2016

(65) Prior Publication Data

US 2016/0356155 A1 Dec. 8, 2016

Related U.S. Application Data

(63) Continuation of application No. 14/273,360, filed on May 8, 2014, now Pat. No. 9,434,091.

(60) Provisional application No. 61/824,007, filed on May 16, 2013.

(51) Int. Cl.

| | |
|---|---|
| ***E21C 35/18*** | (2006.01) |
| ***E21C 35/183*** | (2006.01) |
| ***B28D 1/18*** | (2006.01) |
| ***E01C 23/088*** | (2006.01) |

(52) U.S. Cl.

CPC ..... *E21C 35/183* (2013.01); *B28D 1/186* (2013.01); *E01C 23/088* (2013.01); *E21C 2035/1813* (2013.01); *E21C 2035/1816* (2013.01)

(58) Field of Classification Search

CPC ..... E21C 35/183; B28D 1/186

See application file for complete search history.

(56) References Cited

U.S. PATENT DOCUMENTS

| | | | |
|---|---|---|---|
| 2,665,893 | A | 1/1954 | Ball |
| 3,342,532 | A | 9/1967 | Krekeler et al. |
| 3,671,075 | A | 6/1972 | Bland et al. |
| 3,695,726 | A | 10/1972 | Krekeler |
| 3,751,114 | A | 8/1973 | Davis |
| 3,785,021 | A | 1/1974 | Noregren et al. |

(Continued)

FOREIGN PATENT DOCUMENTS

| | | |
|---|---|---|
| AU | 2013101370 | 11/2013 |
| CN | 102108866 | 6/2011 |

(Continued)

OTHER PUBLICATIONS

Advisory Action received for U.S. Appl. No. 14/266,437 dated Mar. 24, 2017.

(Continued)

*Primary Examiner* — John J Kreck

(74) *Attorney, Agent, or Firm* — Dorsey & Whitney LLP

(57) ABSTRACT

Embodiments disclosed herein are directed to a system for removing road material. In an embodiment, the system may include a milling drum and at least one pick mounted on the milling drum. The pick may include polycrystalline diamond at least partially forming one or more working surfaces of the pick.

18 Claims, 11 Drawing Sheets

(56) References Cited

U.S. PATENT DOCUMENTS

| | | | | |
|---|---|---|---|---|
| 3,841,708 | A | 10/1974 | Kniff et al. | |
| D238,243 | S | 12/1975 | Polivka | |
| 3,958,832 | A | 5/1976 | Sigott et al. | |
| 4,006,936 | A | 2/1977 | Crabiel | |
| 4,083,644 | A | 4/1978 | Friedline et al. | |
| 4,140,189 | A | 2/1979 | Garner | |
| 4,193,638 | A | 3/1980 | Heckenhauer | |
| 4,200,159 | A | 4/1980 | Jurgens et al. | |
| 4,299,424 | A | 11/1981 | LeBegue et al. | |
| 4,303,136 | A | 12/1981 | Ball | |
| 4,335,921 | A | 6/1982 | Swisher, Jr. et al. | |
| 4,337,980 | A | 7/1982 | Krekeler et al. | |
| 4,340,325 | A | 7/1982 | Gowanlock et al. | |
| D270,059 | S | 8/1983 | Wilkins | |
| D271,497 | S | 11/1983 | Green | |
| 4,484,644 | A | 11/1984 | Cook et al. | |
| 4,580,930 | A | 4/1986 | Zinner et al. | |
| 4,605,343 | A | 8/1986 | Hibbs, Jr. et al. | |
| 4,655,508 | A | 4/1987 | Tomlinson | |
| 4,678,237 | A | 7/1987 | Collin | |
| 4,679,858 | A | 7/1987 | Tank | |
| D296,107 | S | 6/1988 | Andersson | |
| 4,784,023 | A | 11/1988 | Dennis et al. | |
| 4,787,466 | A | 11/1988 | Tomlinson et al. | |
| 4,836,178 | A | 6/1989 | Tomlinson | |
| 4,850,649 | A | 7/1989 | Beach et al. | |
| 4,880,278 | A | 11/1989 | Tomlinson et al. | |
| 4,902,073 | A | 2/1990 | Tomlinson et al. | |
| D307,279 | S | 4/1990 | Vincent | |
| 4,913,125 | A | 4/1990 | Bunting et al. | |
| D311,747 | S | 10/1990 | Mihic | |
| 5,007,685 | A | 4/1991 | Beach et al. | |
| 5,060,739 | A | 10/1991 | Griffin et al. | |
| 5,090,491 | A | 2/1992 | Tibbitts et al. | |
| 5,318,351 | A | 6/1994 | Walker | |
| 5,378,050 | A | 1/1995 | Kammerer et al. | |
| 5,417,475 | A * | 5/1995 | Graham | E21B 10/46 175/427 |
| 5,431,239 | A | 7/1995 | Tibbitts et al. | |
| 5,605,382 | A | 2/1997 | Massa et al. | |
| 5,649,604 | A | 7/1997 | Fuller et al. | |
| 5,690,393 | A | 11/1997 | Massa et al. | |
| 5,881,830 | A | 3/1999 | Cooley | |
| 6,089,123 | A | 7/2000 | Chow et al. | |
| 6,213,931 | B1 | 4/2001 | Twardowski et al. | |
| 6,283,844 | B1 | 9/2001 | Tank | |
| 6,485,104 | B1 | 11/2002 | Keller et al. | |
| 6,779,850 | B1 | 8/2004 | Schibeci et al. | |
| 7,108,212 | B2 | 9/2006 | Latham | |
| D558,802 | S | 1/2008 | Nicholas | |
| D616,003 | S | 5/2010 | Ueda et al. | |
| 7,866,418 | B2 | 1/2011 | Bertagnolli et al. | |
| 7,998,573 | B2 | 8/2011 | Qian et al. | |
| 8,034,136 | B2 | 10/2011 | Sani | |
| 8,047,260 | B2 | 11/2011 | Uno et al. | |
| 8,079,785 | B2 | 12/2011 | Nicholas | |
| 8,236,074 | B1 | 8/2012 | Bertagnolli et al. | |
| D666,640 | S | 9/2012 | Cox et al. | |
| 8,567,533 | B2 | 10/2013 | Myers et al. | |
| 8,672,415 | B2 | 5/2014 | Neilson et al. | |
| 8,727,044 | B2 | 5/2014 | Qian et al. | |
| 8,789,894 | B2 | 7/2014 | Claesson et al. | |
| 9,017,438 | B1 | 4/2015 | Miess et al. | |
| 9,027,675 | B1 | 5/2015 | Jones et al. | |
| 9,028,008 | B1 | 5/2015 | Bookhamer et al. | |
| 9,238,893 | B2 | 1/2016 | Latham et al. | |
| 9,272,392 | B2 | 3/2016 | Mukhopadhyay et al. | |
| 9,272,814 | B2 | 3/2016 | Carver et al. | |
| 9,303,511 | B2 | 4/2016 | George et al. | |
| 9,382,794 | B2 | 7/2016 | Latham et al. | |
| 9,434,091 | B2 * | 9/2016 | Burton | B28D 1/186 |
| 9,593,577 | B2 | 3/2017 | Ries et al. | |
| D809,031 | S | 1/2018 | Burton | |
| 10,018,041 | B2 | 7/2018 | Wachsmann et al. | |
| 2001/0040053 | A1 | 11/2001 | Beuershausen et al. | |
| 2002/0153175 | A1 | 10/2002 | Ojanen et al. | |
| 2003/0234569 | A1 * | 12/2003 | Dawood | E21C 35/18 299/108 |
| 2005/0082898 | A1 | 4/2005 | Keller et al. | |
| 2006/0033379 | A1 | 2/2006 | Frear et al. | |
| 2006/0087169 | A1 | 4/2006 | Hesse et al. | |
| 2007/0090679 | A1 | 4/2007 | Ojanen et al. | |
| 2008/0030065 | A1 | 2/2008 | Frear et al. | |
| 2008/0035383 | A1 | 2/2008 | Hall et al. | |
| 2008/0036280 | A1 | 2/2008 | Hall et al. | |
| 2008/0202819 | A1 | 8/2008 | Fader | |
| 2008/0250724 | A1 | 10/2008 | Hall et al. | |
| 2008/0309146 | A1 | 12/2008 | Hall et al. | |
| 2009/0256413 | A1 | 10/2009 | Majagi | |
| 2010/0052406 | A1 | 3/2010 | Beach et al. | |
| 2010/0194176 | A1 | 8/2010 | Lucek et al. | |
| 2010/0244545 | A1 * | 9/2010 | Hall | E21C 35/183 299/105 |
| 2010/0326741 | A1 | 12/2010 | Patel | |
| 2011/0132667 | A1 | 6/2011 | Smallman et al. | |
| 2011/0148178 | A1 | 6/2011 | Lehnert et al. | |
| 2011/0233987 | A1 | 9/2011 | Maushart et al. | |
| 2011/0266070 | A1 | 11/2011 | Scott et al. | |
| 2012/0043138 | A1 | 2/2012 | Myers et al. | |
| 2012/0160573 | A1 | 6/2012 | Myers et al. | |
| 2012/0175939 | A1 | 7/2012 | O'Neill et al. | |
| 2012/0279786 | A1 | 11/2012 | Cox | |
| 2013/0052481 | A1 | 2/2013 | Konyashin | |
| 2013/0092451 | A1 | 4/2013 | Mukhopadhyay et al. | |
| 2013/0092452 | A1 | 4/2013 | Mukhopadhyay et al. | |
| 2013/0322975 | A1 | 12/2013 | Tan et al. | |
| 2014/0110991 | A1 | 4/2014 | Sollami | |
| 2014/0175853 | A1 | 6/2014 | Warren | |
| 2014/0225418 | A1 | 8/2014 | Lachmann et al. | |
| 2014/0240634 | A1 | 8/2014 | Matsuzaki | |
| 2014/0339879 | A1 | 11/2014 | Burton et al. | |
| 2014/0339883 | A1 | 11/2014 | Burton et al. | |
| 2015/0035342 | A1 | 2/2015 | Jonker et al. | |
| 2015/0114727 | A1 | 4/2015 | Heuser | |
| 2015/0176408 | A1 | 6/2015 | Latham | |
| 2015/0176409 | A1 | 6/2015 | Latham | |
| 2015/0240635 | A1 | 8/2015 | Lachmann et al. | |
| 2015/0314483 | A1 | 11/2015 | Miess et al. | |
| 2016/0102550 | A1 | 4/2016 | Swope et al. | |
| 2016/0273356 | A1 | 9/2016 | Ojanen et al. | |
| 2016/0332269 | A1 | 11/2016 | Prezlock et al. | |

FOREIGN PATENT DOCUMENTS

| | | |
|---|---|---|
| CN | 202073564 | 12/2011 |
| CN | 203081445 | 7/2013 |
| GB | 1481278 | 7/1977 |
| GB | 2170843 | 8/1986 |
| GB | 2177144 | 1/1987 |
| GB | 2193740 | 2/1988 |
| WO | WO 2010/083015 | 7/2010 |
| WO | WO 2012/130870 | 10/2012 |
| WO | WO 2016/071001 | 5/2016 |

OTHER PUBLICATIONS

Non-Final Office Action for U.S. Appl. No. 14/266,437 dated Apr. 21, 2017.

Non-Final Office Action received for U.S. Appl. No. 14/275,574 dated Apr. 7, 2017.

Non-Final Office for U.S. Appl. No. 29/555,279 dated Mar. 24, 2017.

Notice of Allowance received for U.S. Appl. No. 29/555,269 dated Apr. 6, 2017.

Notice of Allowance received for U.S. Appl. No. 29/555,281 dated Apr. 12, 2017.

Supplemental Notice of Allowance for U.S. Appl. No. 29/555,269.

U.S. Appl. No. 12/961,787, filed Dec. 7, 2010, Mukhopadhyay et al.

U.S. Appl. No. 13/027,954, filed Feb. 15, 2011, Miess et al.

U.S. Appl. No. 13/070,636, filed Mar. 24, 2011, Qian et al.

U.S. Appl. No. 13/100,388, filed May 4, 2011, Jones et al.

(56) References Cited

OTHER PUBLICATIONS

U.S. Appl. No. 13/275,372, filed Oct. 18, 2011, Mukhopadhyay et al.
U.S. Appl. No. 13/648,913, filed Oct. 10, 2012, Mukhopadhyay et al.
U.S. Appl. No. 13/765,027, filed Feb. 12, 2013, Carver, et al.
U.S. Appl. No. 13/795,027, filed Mar. 12, 2013, Mukhopadhyay et al.
U.S. Appl. No. 61/824,022, filed May 16, 2013, Burton et al.
U.S. Appl. No. 61/824,007, filed May 16, 2013, Burton et al.
U.S. Appl. No. 14/266,437, filed Apr. 30, 2014, Miess et al.
U.S. Appl. No. 14/273,360, filed May 8, 2014, Burton et al.
U.S. Appl. No. 14/275,574, filed May 12, 2014, Burton et al.
U.S. Appl. No. 62/030,525, filed Jul. 29, 2014, Myers et al.
U.S. Appl. No. 14/811,699, filed Jul. 28, 2015, Myers et al.
U.S. Appl. No. 62/232,732, filed Sep. 25, 2015, Weaver et al.
U.S. Appl. No. 29/540,584, filed Sep. 25, 2015, Weaver.
U.S. Appl. No. 29/540,597, filed Sep. 25, 2015, Weaver.
U.S. Appl. No. 29/555,269, filed Feb. 19, 2016, Burton.
U.S. Appl. No. 29/555,279, filed Feb. 19, 2016, Burton.
U.S. Appl. No. 29/555,281, filed Feb. 19, 2016, Burton.
International Search Report and Written Opinion from International Application No. PCT/US2014/037708 dated Oct. 30, 2014.
International Search Report and Written Opinion from International Application No. PCT/US2014/037381 dated Oct. 30, 2014.
International Search Report and Written Opinion for International Application No. PCT/US2015/027830 dated Jul. 14, 2015.
Roepke et al.; "Drag Bit Cutting Characteristics Using Sintered Diamond Inserts" Report of Investigations 8802; Bureau of Mines Report of Investigations/ 1983; (1983) 35 pages.
U.S. Appl. No. 14/273,360, Jun. 12, 2015, Restriction Requirement.
U.S. Appl. No. 14/273,360, Oct. 22, 2015, Office Action.
U.S. Appl. No. 14/273,360, Mar. 7, 2016, Office Action.
U.S. Appl. No. 14/273,360, May 18, 2016, Notice of Allowance.
U.S. Appl. No. 14/273,360, Aug. 10, 2016, Supplemental Notice of Allowance.
Final Office Action for U.S. Appl. No. 14/266,437 dated Dec. 12, 2016.
Final Office Action for U.S. Appl. No. 14/275,574 dated Nov. 29, 2016.
Issue Notification for U.S. Appl. No. 14/273,360 dated Aug. 17, 2016.
Non-Final Office Action for U.S. Appl. No. 14/266,437 dated Jun. 9, 2016.
Non-Final Office Action for U.S. Appl. No. 14/275,574 dated Apr. 6, 2016, dated May 12, 2016.
Advisory Action received for U.S. Appl. No. 14/275,574 dated Mar. 9, 2017.
Final Office Action for U.S. Appl. No. 14/266,437 dated Nov. 15, 2017.
Issue Notification for U.S. Appl. No. 29/555,279 dated Jan. 10, 2018.
Non-Final Office Action for U.S. Appl. No. 14/811,699 dated Nov. 29, 2017.
Non-Final Office Action for U.S. Appl. No. 15/266,355 dated Jan. 8, 2018.
Notice of Allowance for U.S. Appl. No. 14/275,574 dated Jan. 24, 2018.
Notice of Allowance for U.S. Appl. No. 29/555,281 dated Jan. 4, 2018.
Supplemental Notice of Allowability for U.S. Appl. No. 29/555,279 dated Jan. 2, 2018.
Supplemental Notice of Allowance for U.S. Appl. No. 29/555,281 dated Feb. 9, 2018.
Issue Notification for U.S. Appl. No. 29/540,584 dated Sep. 14, 2017.
Issue Notification for U.S. Appl. No. 29/540,597 dated Sep. 6, 2017.
Notice of Allowance for U.S. Appl. No. 14/275,574 dated Sep. 26, 2017.
Notice of Allowance for U.S. Appl. No. 29/555,279 dated Aug. 31, 2017.
Supplemental Notice of Allowance for U.S. Appl. No. 29/540,584 dated Sep. 7, 2017.
Supplemental Notice of Allowance for U.S. Appl. No. 29/540,597 dated Aug. 25, 2017.
Supplemental Notice of Allowance for U.S. Appl. No. 29/555,281 dated Jun. 12, 2017.
Non-Final Office Action for U.S. Appl. No. 14/266,437 dated Mar. 28, 2018.
Notice of Allowance for U.S. Appl. No. 29/540,584 dated May 8, 2017.
Notice of Allowance for U.S. Appl. No. 29/540,597 dated May 8, 2017.
Supplemental Notice of Allowance for U.S. Appl. No. 29/540,597 dated Jun. 1, 2017.
Final Office Action for U.S. Appl. No. 14/811,699 dated Jul. 10, 2018.
Final Office Action for U.S. Appl. No. 15/266,355 dated Jul. 25, 2018.
Issue Notification for U.S. Appl. No. 29/555,281 dated Aug. 29, 2018.
Notice of Allowance for U.S. Appl. No. 14/275,574 dated Jun. 15, 2018.
Notice of Allowance for U.S. Appl. No. 29/555,281 dated May 16, 2018.
Supplemental Notice of Allowance for U.S. Appl. No. 29/555,281 dated Jun. 4, 2018.
U.S. Appl. No. 14/275,574, filed May 12, 2014.
Advisory Action for U.S. Appl. No. 14/811,699 dated Oct. 22, 2018.
Advisory Action for U.S. Appl. No. dated Oct. 11, 2018.
Final Office Action for U.S. Appl. No. 14/266,437 dated Sep. 18, 2018.
Non-Final Office Action for U.S. Appl. No. 14/266,437 dated Jan. 8, 2019.
Non-Final Office Action for U.S. Appl. No. 14/811,699 dated Jan. 4, 2019.
Non-Final Office Action for U.S. Appl. No. 15/266,355 dated Nov. 29, 2018.
Notice of Allowance for U.S. Appl. No. 14/275,574 dated Oct. 11, 2018.
Supplemental Notice of Allowability for U.S. Appl. No. 14/275,574 dated Oct. 31, 2018.
Notice of Allowance for U.S. Appl. No. 14/275,574 dated Feb. 12, 2019.

* cited by examiner

PICK INCLUDING POLYCRYSTALLINE DIAMOND COMPACT

CROSS-REFERENCE TO RELATED APPLICATIONS

This application is a continuation of U.S. patent application Ser. No. 14/273,360 filed on 8 May 2014, which claims priority to U.S. Provisional Application No. 61/824,007 filed on 16 May 2013. The disclosure of each of the foregoing applications is incorporated herein, in their entirety, by this reference.

BACKGROUND

Milling and grinding machines are commonly used in the asphalt and pavement industries. In many cases, maintaining paved surfaces with grinding and milling machines may significantly increase the life of the roadway. For example, a road surface that has developed high points is at greater risk for failure because vehicles and heavy trucks that hit the high point may bounce on the road. Over time, the impact forces may damage to the road surface.

Additionally, portions of the road surface may occasionally need to be ground down to remove road markings, such as centerlines or crosswalk markings. For instance, when roads are expanded or otherwise changed, the road markings also may need to be changed. In any event, at least a portion of material forming a road surface may be removed for any number of reasons.

Typically, removal of material forming the road surface wears the tools and equipment used therefor. Moreover, tool and equipment wear may reduce useful life thereof. Therefore, manufacturers and users continue to seek improved road-removal systems and apparatuses to extend the useful life of such system and apparatuses.

SUMMARY

Embodiments of the invention relate to road-removal devices, systems, and methods. In particular, embodiments include road-removal devices and systems that incorporate superhard material, such as polycrystalline diamond compact ("PDC"). For instance, the PDCs may include one or more cutting edges that may be sized and configured to engage the road surface during road-removal operations. Moreover, engaging the road material with the cutting edge(s) may cut, shear, grind, or otherwise fail the road material and may facilitate removal thereof. In some embodiments, failing the road material may produce a relatively smoother road surface, which may increase the useful life of the road.

At least one embodiment includes a system for removing a road material. The system includes a milling drum that is rotatable about a rotation axis. Moreover, the milling drum is an operably coupled motor configured to rotate the milling drum about the rotation axis. The system also includes a plurality of picks mounted on the milling drum. Each of the plurality of picks includes a pick body and a PDC attached to the pick body. Each PDC has a substantially planar working surface and forms at least a portion of a cutting edge.

Embodiments are also directed to a method of removing road material. The method includes advancing a plurality of picks toward road material. Each of the plurality of picks includes a PDC that forms a substantially planar working surface and at least a portion of a cutting edge of the pick. The method further includes advancing the cutting edges and the substantially planar working surfaces of the picks into the road material, thereby failing at least some of the road material while having the working surfaces oriented at one or more of a positive rake angle or negative rake angle.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments of the invention relate to road-removal devices, systems, and methods. In particular, embodiments include road-removal devices and systems that incorporate a superhard material, such as PDC. For instance, the PDCs may include one or more cutting edges that may be sized and configured to engage the road material during road-removal operations. Moreover, engaging the road material with the cutting edge(s) may cut, shear, grind, or otherwise fail the road material and may facilitate removal thereof. In some embodiments, failing the road material may produce a relatively smooth or flat road surface, which may increase the useful life of the road.

Figure 1A:
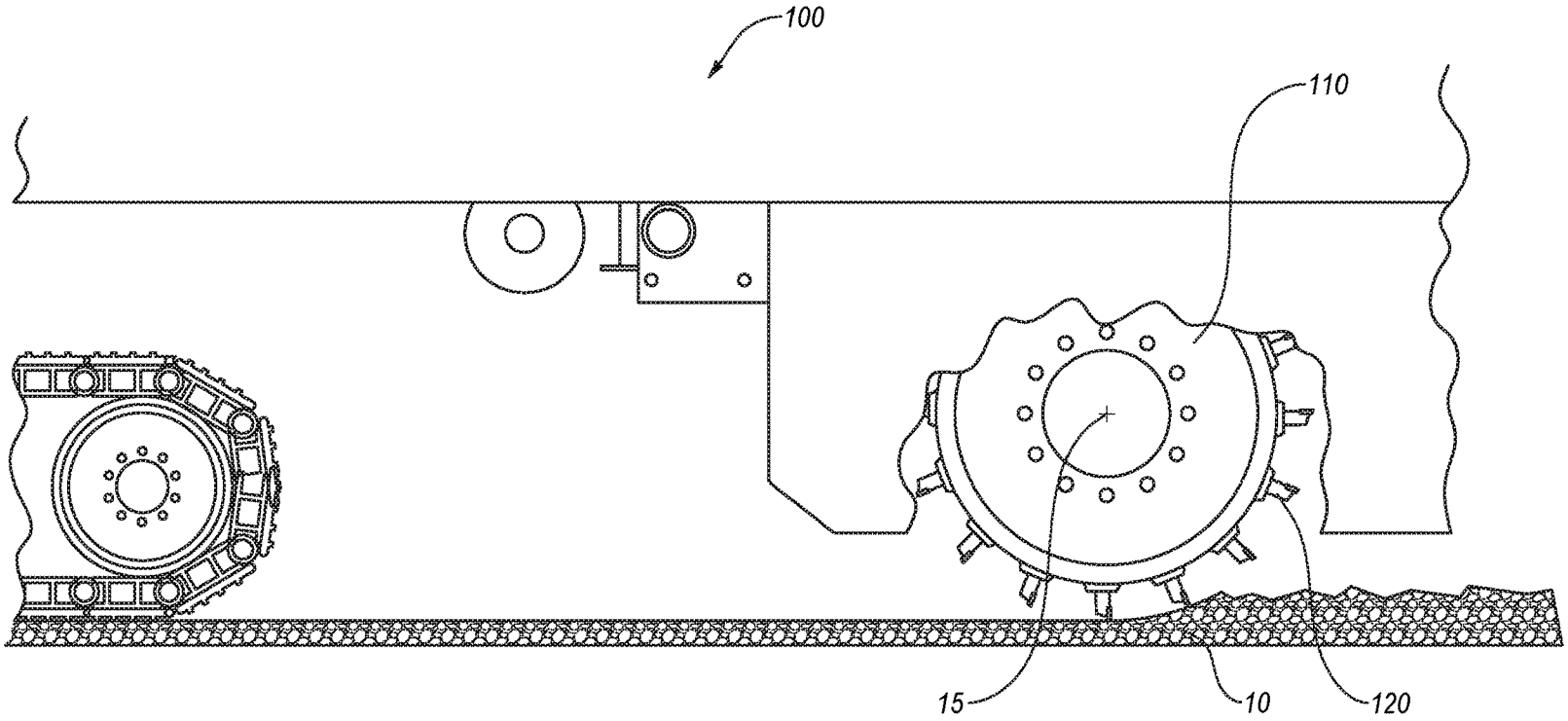
FIG. 1A is a schematic illustration of a road-removal system according to an embodiment.
Figure 1B:
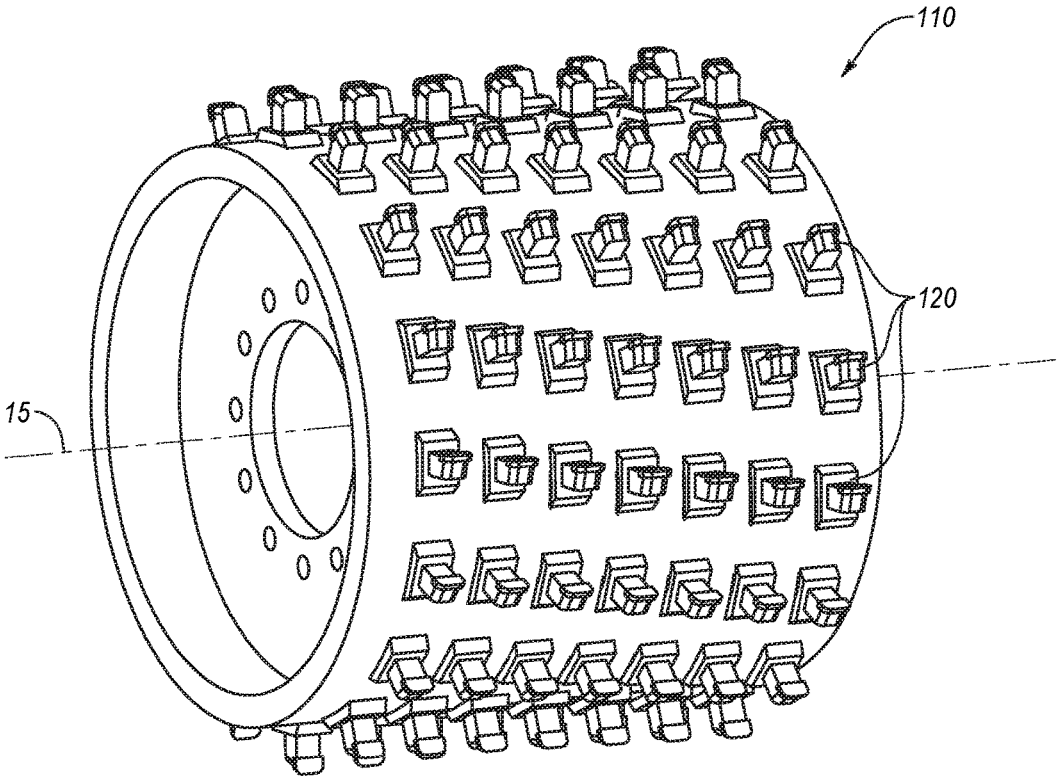
FIG. 1B is an isometric view of a milling drum according to an embodiment.
Figure 1C:
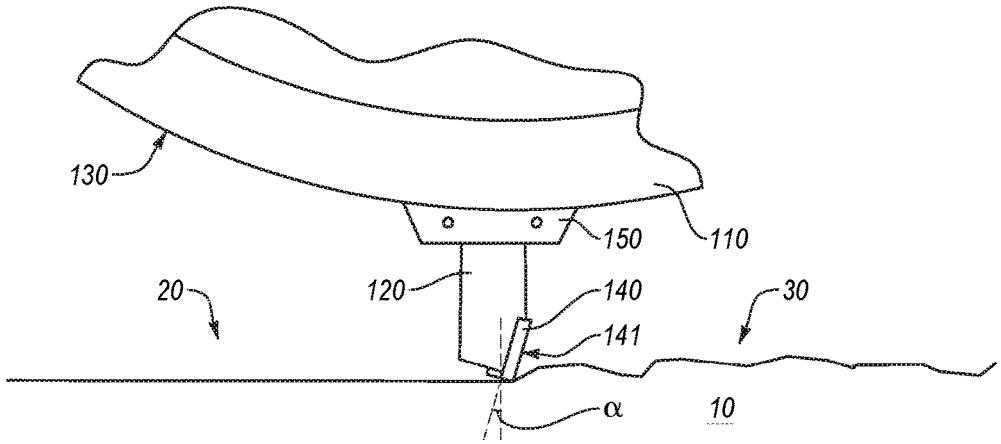
FIG. 1C is a side view of the milling drum of FIG. 1B having at least one pick engaged with road material according to an embodiment.

FIGS. 1A-1C illustrate an embodiment of a road-removal system 100. FIG. 1A illustrates the road-removal system 100 during operation thereof, failing and/or removing road material 10. For example, the road-removal system 100 includes a milling drum 110 that may rotate about a rotation axis 15 together with picks 120, which may be attached to and protrude from the milling drum 110. The milling drum 110 may be operably coupled to a motor that may rotate the milling drum 110 and the picks 120 about the rotation axis 15. During rotation of the milling drum 110, the picks 120 may engage and fail the road material 10.

Generally, any number of picks 120 may be attached to the milling drum 110. Moreover, particular sizes, shapes, and configurations of picks may vary from one embodiment to the next. In some instances, a pick configuration that may be used for removing an entire thickness or all of the road material 10 may be different from another pick configuration that may be used to smooth the road surface and/or remove imperfections therefrom.

In some instances, bumpy and uneven road surfaces may lead to excessive wear and shorten the life of the road surface. In one or more embodiments, the picks 120 may be configured to remove at least a portion of the road material 10 and recreate or renew the road surface. In particular, in an embodiment, the picks 120 may grind, cut, or otherwise fail the road material 10 as the milling drum 110 rotates, and the failed road material may be subsequently removed (e.g., by the road-removal system 100). In some embodiments, the picks 120 do not remove all of the road material but only remove some road material, such as a limited or predetermined thicknesses thereof (e.g., measured from the road surface), which may remove abnormalities, bulges, etc., from the road surface.

The road-removal system 100 may also be used for adding and removing road markings, such as epoxy or paint lines. Road markings may include highly visible and wear-resistant material. In some cases, the road marking material may be difficult to remove from the road surface without damaging or destroying the road surface. Furthermore, some instances may require removal of existing road markings and placement of new road markings (e.g., a construction project may temporarily or permanently reroute traffic and may require new lane markings).

Insufficient or incomplete removal of road markings, however, may lead to dangerous road conditions. For example, a driver may be unable to distinguish between the former lanes and the new lanes. In some cases, removing road markings may involve removing at least some of the road material 10 together with the markings that are affixed thereto. In any event, in an embodiment, the picks 120 may be configured to remove paint and/or epoxy from the road material 10. In some instances, a relatively narrow milling drum with a relatively narrow or tight pick distribution may be used to remove road markings, such as paint and epoxy, which may localize the removal of the road material 10 to the area that approximates the size and shape of the removed road markings. In other words, in an embodiment, the picks 120 may be set to remove the road marking and a thin layer of road material 10 below the road marking such that no trace of the marking remains.

Similarly, in an embodiment, the road-removal system 100 may be used to inlay paint or epoxy within the road material 10. Inlaying paint or epoxy within the road surface can provide protection to the paint of epoxy. Thus, similar to the one or more embodiments described above, the road-removal system 100 may be used to create narrow strips or recesses within the road material 10 (e.g., at a predetermined depth from the road surface). In particular, for instance, created recesses may be sized and shaped to approximately the desired size and shape of the road markings (e.g., epoxy, paint, etc.). In an embodiment, the picks 120 may be operated dry, such as without or with limited amount of fluid or coolant provided to the picks 120 during the removal of the road material 10. Absence of fluid on the road material 10 may facilitate application of paint, epoxy, or other road marking material to the road surface (e.g., reducing time between removal of road material 10 and application of road markings).

Further, in an embodiment, the road-removal system 100 may be used to create water flow channels. Improper or ineffective water drainage on road surfaces 10 may create safety problems and may lead to road damage. For instance, if standing water is left on the road surface, hydroplaning and/or ice may result, which may cause accidents. Additionally, the expansion of freezing water on the road material 10 may cause the road material 10 to buckle and/or crack. Accordingly, in at least one embodiment, the road-removal system 100 may be used to form water flow channels in the road material 10.

FIG. 1B illustrates an isometric view of the milling drum 110. In an embodiment, the milling drum 110 may rotate about the rotation axis 15 together with a plurality of picks 120 mounted or otherwise secured to the milling drum 110 and projecting from a surface 130 thereof. While the milling drum 110 has a particular density and configuration of the pick 120 placement, a variety of different pick configurations and pick spacing may be used. For example, if the milling drum 110 is being configured to smooth or flatten the road material 10, it may be desirable to use a pick configuration that exhibits a high density and a high uniformity of pick placement and a type of the pick 120 that does not deeply penetrate the road material 10. In an embodiment, the milling drum 110 may be suitable for use in machining, grinding, or removing imperfections from a road material 10.

The particular type of pick as well as mounting position and/or orientation thereof on the milling drum 110 may affect removal of road material 10. FIG. 1C illustrates an embodiment of the milling drum 110, which includes multiple picks 120 mounted about an outer surface 130 of the milling drum 110. In some embodiments, the picks 120 may be mounted in one or more holders or mounting bases 150, which may facilitate attachment of the picks 120 to the milling drum 110 as well as removal and replacement of the picks.

In some instances, the mounting bases 150 may be larger than pick bodies of the picks 120, which may limit the density of picks 120 in a single row as well as the number of rows on the milling drum and/or combined length of cutting edges (i.e., the sum of lengths of all cutting edges), by limiting minimum distance between adjacent picks 120. Hence, in an embodiment, the milling drum may produce a reconditioned surface 20 that includes multiple grooves or striations formed by the picks 120. Alternatively, however, the milling drum may produce a substantially uniform or flat surface, without grooves or with minimal grooves. For example, the picks 120 may be offset one from another in a manner that provides overlap of cutting edges along a width of the milling drum in a manner that produces a flat surface.

In an embodiment, the pick 120 includes a PDC 140 affixed to an end region or portion of the pick body, as described below in more detail. Moreover, in an embodiment, the PDC 140 includes a cutting edge (described below in more detail), which extends between a substantially planar working surface 141 and at least one side surface. For example, the cutting edge may be adapted to cut, grind, scrape, or otherwise fail the road material 10. Additionally or alternatively, in some embodiments, the cutting edge or face of the pick 120 may have a conical or rounded peripheral shape, which may create a grooved or uneven surface (e.g., as compared to a flat and smooth reconditioned road surface 20, which may be formed by the picks 120 with planar working surfaces).

In some instances, the pick 120 may remove an upper layer or portion of the road material 10. Specifically, in an embodiment, in contrast to using an impact and crushing force to break apart the road surface, the cutting edge of the pick 120 may scrape, shear, cut, or otherwise fail the road material 10 (e.g., to a predetermined depth). In some instances, cutting through the road material 10 (e.g., through upper portion of the road material 10) may provide substantially more control over the amount of road material 10 that is removed from the road surface than removing road material 10 by crushing and impacting the road material 10.

In some embodiments, at least a portion of the cutting edge of the pick 120 may be substantially straight or linear. Accordingly, in an embodiment, the road-removal system 100 that includes multiple picks 120 may produce a substantially flat or planar reconditioned road surface 20. Also, in some embodiments, the unfinished road surface 30 that is in front of the pick 120 may be rough and uneven. In an embodiment, as the milling drum 110 rotates and causes the pick 120 to engage the unfinished road surface 30, the cutting edge of the pick 120 grinds and/or scrapes the unfinished road surface 30 and road material 10, thereby removing imperfections and undesirable artifacts from the unfinished road surface 30 and producing the reconditioned road surface 20.

Additionally, the substantially planar working surface 141 of the PDC 140 may form a suitable or an effective back rake angle a, as described in further detail below. In particular, the back rake angle a may be formed between the working surface 141 and a vertical reference axis (e.g., an axis perpendicular to a tangent line at the lowermost point of contact between the pick 120 and the road material 10). In AN embodiment, the vertical reference axis may be approximately perpendicular to the reconditioned road surface 20. Accordingly, in some embodiments, the working surface 141 of the PDC 140 may be oriented at a non-perpendicular angle relative to the reconditioned road surface 20, when the cutting edge of the PDC 140 is at the lowermost position relative to the surface of the road material 10. In other words, the working surface may be oriented at a non-perpendicular angle relative to an imaginary line tangent to the rotational path of the cutting edge of the pick.

The back rake angle a may aid in evacuating or clearing cuttings or failed road material during the material removal process. In some embodiments, as shown in FIG. 1C, the back rake angle a may be a negative back rake angle (i.e., forming an obtuse angle with the reconditioned road surface 20 when the cutting edge of the PDC 140 is at the lowest rotational position). Alternatively, as described below in more detail, the back rake angle may be a positive rake angle. Moreover, the milling drum 110 may include any number of picks that include PDC oriented in a manner that forms negative and/or positive back rake angles during operation of the milling drum 110.

Additionally, under some operating conditions, the road-removal system 100 may remove road material to a specific or predetermined depth. In some cases, such as with especially thick or multiple layers of the road material 10, the system may remove the road material 10 over multiple passes or in a single pass having a sufficiently deep cut. In contrast, a thin layer of road material 10 may be removed with a shallow cut. In any event, a variety of cutting depths can be set without interfering with the shearing configuration of the PDCs.

The depth of placement or positioning of the milling drum 110, which may at least partially determine the depth to which the pick 120 engages the road material 10, may be controlled by any number of suitable methods and apparatuses. Also, in some embodiments, the picks 120 and the road-removal system may be configured to remove less than approximately 60 cm of road surface during the grinding operation. Furthermore, in an embodiment, the picks 120 and the road-removal system may be configured to remove less than approximately 30 cm of road surface, less than approximately 20 cm of road surface, less than approximately 10 cm of road surface, less than approximately 1 cm, or approximately 4 mm to approximately 6 mm of road surface.

In some applications, removing an excessive amount of road material may lead to a significant reduction in the life of the road. Hence, it should be appreciated that the picks may have any number of suitable sizes, shapes, or configurations (e.g., PDCs and pick bodies may have various configurations), which may vary from one embodiment to the next and may affect removal of the road material 10. In any case, however, a pick may include polycrystalline diamond that includes a cutting edge configured to grind, mill, or otherwise fail a layer or portion of the road material 10 that may be subsequently removed.

Figure 2A:
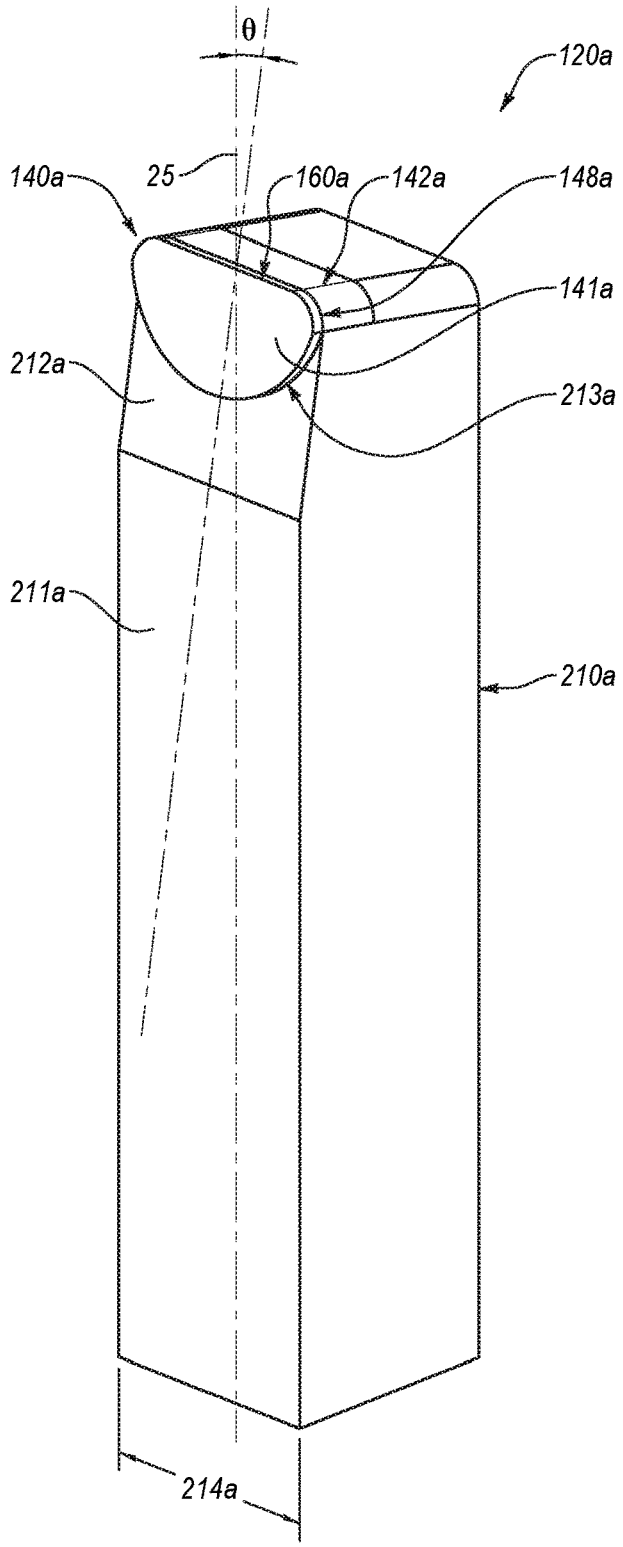
FIG. 2A is an isometric view of a pick according to an embodiment.

FIG. 2A illustrates a pick 120*a* according to an embodiment. In particular, in an embodiment, the pick 120*a* includes a PDC 140*a* mounted or attached to a pick body 210*a*. Except as otherwise described herein, the pick 120*a* and its materials, elements, or components may be similar to or the same as any of the picks 120 (FIGS. 1A-1C) and its respective materials, elements, and components. In some embodiments, the PDC 140*a* includes a substantially planar working surface 141*a*. For instance, the working surface 141*a* may have an approximately semicircular shape or may have the shape of a truncated or divided circle. It should be appreciated that the PDC 140*a* and the working surface 141*a* may have any number of other configurations that may vary from one embodiment to the next.

In an embodiment, at least one peripheral edge of the working surface 141*a* may form or define a cutting edge 160*a*. In some instances, at least a portion of the cutting edge 160*a* may be approximately straight or linear. For example, the linear portion of the cutting edge 160*a* may form or define a lowermost edge of the pick 120*a* during operation or engagement thereof with the road material. In other words, the bottom or the lowermost portion of the cut in the road material produced by the pick 120*a* may be formed or defined by the cutting edge 160*a*.

Moreover, in at least one embodiment, the cutting edge 160*a* may be formed between the working surface 141*a* and a top surface 142*a* of the PDC 140*a*. In other words, a sharp corner between the working surface 141*a* and the top surface 142*a* may define the cutting edge 160*a*. Alternatively, the PDC 140*a* may include a chamfer that extends between the working surface 141*a* and the top surface 142*a*. Hence, in an embodiment, the cutting edge may be formed by a sharp corner between the working surface 141*a* and the chamfer and/or by the sharp corner between the top surface 142*a* and the chamfer. Also, in some embodiments, the cutting edge may be formed by the chamfer (e.g., the cutting edge may be defined by the surface of the chamfer).

In an embodiment, the PDC 140*a* may be formed by cutting or splitting a generally round or cylindrical PDC into two halves, thereby producing two PDCs, such as the PDC 140*a*. Also, in some embodiments, the cutting edge 160*a* of the PDC 140*a* may include one or more rounded portions 148*a*. For instance, otherwise sharp corners formed between the straight portion of the cutting edge 160*a* and the semi-circular peripheral portion of the PDC 140*a* may be rounded to form the rounded portions 148*a*. Moreover, in some instances, the rounded portions 148*a* may be exposed or may otherwise protrude out of the pick body 210*a* in a manner that facilitates engagement thereof with the road material. That is, the rounded portions 148*a* may engage and cut or otherwise fail the road material during operation of a road-removal system that includes the pick 120*a*.

It should be appreciated that, in some embodiments, the cutting edge of the PDC may include chamfers in lieu of or in addition to the rounded portions. In some instances, rounded portions and/or chamfers may provide better force distribution on the PDC and on the cutting edge thereof. In contrast, in some operating conditions, sharp edges and/or sharp corners may chip and/or break from the PDC.

In an embodiment, the PDC 140*a* may be received into and/or secured within a partial cylindrical pocket or recess on the pick body 210*a*. As described in more detail below, in an embodiment, the recess in the pick body 210*a* may create a better force distribution between the PDC 140*a* and the pick body 210*a*. In at least one additional or alternative embodiment, the PDC may have a square or rectangular shape. Accordingly, the pick body may include a complementary square or rectangular shaped recess that may accommodate the corresponding shape of the PDC.

In an embodiment, the PDC 140*a* may form a back rake angle θ relative to the pick body 210*a*. For example, the back rake angle θ may be in one or more of the following ranges: between approximately 0 and approximately 45 degrees; between approximately 0 and approximately 30 degrees; between approximately 0 and approximately 25 degrees, between approximately 0 and approximately 20 degrees; between approximately 0 and approximately 15 degrees; between approximately 0 and approximately 10 degrees; or between approximately 0 and approximately 5 degrees. Additionally, the back rake angle θ may be an angle of approximately 6 to approximately 14 degrees, approximately 8 to approximately 12 degrees, or approximately 10 degrees. In some embodiments, the back rake angle θ may be greater than 45 degrees. Also, in at least one embodiment, the back rake may be a positive back rake forming an angle in one or more of the above recited ranges. In an embodiment, the back rake angle θ may aid in evacuating or clearing cuttings during removal of the road material.

It should be appreciated that one or more faces of the pick body 210*a* may orient the pick 120*a* and the PDC 140*a* relative to the milling drum. Accordingly, the PDC 140*a* may be oriented at a predetermined angle relative to the milling drum (e.g., relative to an imaginary radius line extending from rotation axis). In another embodiment, the back rake angle θ may be defined between the working surface 141*a* and an imaginary longitudinal line 25 that extends from the cutting edge 160*a* and which may be perpendicular to a tangent line of the rotational path of the pick 120*a* when the pick 120*a* rotates about the rotation axis of the milling drum.

In at least one embodiment, the pick body 210*a* may include at least one planar face. For instance, the front face 211*a* of the pick body 210*a* may be approximately flat or planar. Hence, in an embodiment, at least one planar face of the pick body 210*a* may orient the pick 120*a* relative to the milling drum (i.e., may provide positional and rotational orientation of the pick 120*a* relative to the surface of the milling drum).

In an embodiment, the longitudinal line 25 (extending along a longitudinal dimension of the pick body 210*a*) may be approximately parallel to one or more faces of the pick body 210*a*. For example, when the pick body 210*a* is secured to the milling drum, the front face 211*a* of the pick body 210*a* may be substantially parallel to the longitudinal line 25. In other words, the longitudinal line 25 may be substantially perpendicular to a line tangent to the path of the cutting edge 160*a* as the pick 120*a* rotates together with the milling drum. Hence, in an embodiment, the front face 211*a* and/or one or more other faces of the pick body 210*a* (e.g., faces oriented at known or predetermined angles relative to the front face 211*a*) may orient the pick 120*a* and the working surface 141*a* relative to the milling drum and the rotation axis thereof.

Generally, it should be appreciated that the pick body 210*a* may have any number of suitable shapes and sizes, which may vary from one embodiment to the next. Moreover, the pick body 210*a* may be shaped in a manner that facilitates securing the pick 120*a* to the milling drum in a manner that positions and orients the working surface 141*a* as described above. Also, in some embodiments, a portion of the pick body 210*a* may have an approximately the same or similar angle as the working surface 141*a* (e.g., relative to the front face 211*a*). For instance, the pick body may include an angled face 212*a*, which may be approximately parallel to the working surface 141*a* (i.e., the angled face 212*a* may approximately match the back rake angle of the working surface 141*a*).

Under some operating conditions, cuttings or failed road material may move over the working surface 141*a* and toward the angled face 212*a*. As noted above, in some instances, the working face 141*a* may deflect or otherwise move the cuttings away from the cutting edge 160*a*, thereby reducing or eliminating contact of the cutting edge with the cuttings (i.e., promoting contact of the cutting edge 160*a* with road material targeted for removal). Furthermore, the angled face 212*a* may also facilitate deflection or movement of the cuttings away from the cutting edge 160*a* and away from the working surface 141*a* during operation of the pick 120*a*.

The PDC 140*a* may be mounted or attached to the pick body 210*a* in any number of suitable ways and with any number of suitable attachment mechanisms, which may vary from one embodiment to another. For example, the pick body 210*a* may include a pocket or recess 213*a* that may accommodate the PDC 140*a* and the PDC 140*a* may be brazed or press-fit in the pocket or recess. More specifically, in an embodiment, the recess 213*a* may have shape and size that may be complementary to the shape and size of the PDC 140*a*. Hence, for instance, the recess 213*a* may locate (e.g., orient, position, etc.) the PDC 140*a* relative to the pick body

210*a* and, consequently, relative to the milling drum when the pick 120*a* is mounted thereon.

In some embodiments, the PDC 140*a* may have an approximately the same or similar width as the pick body 210*a*. For example, the PDC 140*a* may have a width that is approximately the same as or less than a width 214*a* of the pick body (e.g., the PDC 140*a* may not protrude past the faces of the pick body 210*a* that define the width 214*a*). Moreover, in an embodiment, as shown in FIG. 2A, the working surface 141*a* of the PDC 140*a* may form or produce no side rake (i.e., side rake of 0 degrees).

Figure 2B:
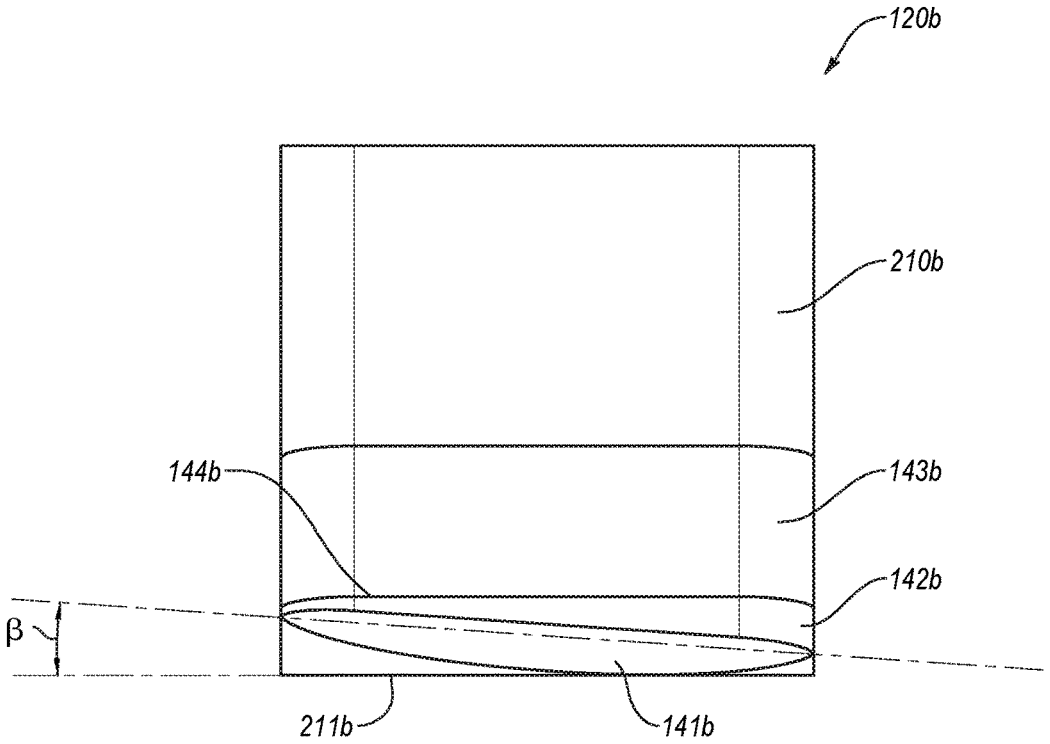
FIG. 2B is a top view of a pick according to an embodiment.

Alternatively, at least a portion or the entire working surface of the PDC may form at least one side rake angle relative to the pick body. For example, as shown in FIG. 2B, a pick 120*b* may include a PDC 140*b* attached to a pick body 210*b* in a manner that a working surface 141*b* of the PDC 140*b* forms a rake angle when the pick 120*b* is mounted on the milling drum. Except as otherwise described herein, the pick 120*b* and its materials, elements, or components may be similar to or the same as any of the picks 120, 120*a* (FIGS. 1A-2A) and their respective materials, elements, and components.

In some embodiments, the working surface 141*b* may form an acute or obtuse angle with one or more sides of the pick body 210*b*. For instance, the working surface 141*b* may be oriented at an acute angle β relative to a front face 211*b* of the pick body 210*b*, which may be the same as the side rake angle of the working surface 141*b*. Moreover, as described above, the working face 141*b* may have a back rake angle (e.g., the working face 141*b* may be at a non-parallel angle relative to the front face 211*b* along a longitudinal direction thereof or relative to a longitudinal line that is parallel to the front face 211*b*). Accordingly, in an embodiment, the working surface 141*b* may be oriented at a compound non-parallel angle relative to the front face 211*b*. In other words, the working surface 141*b* may be oriented at acute and/or obtuse angles relative to the front face 211*b* along multiple imaginary planes (e.g., in a three-dimensional coordinate system).

As described more fully below, the PDC 140*b* may include a PCD table 142*b* bonded to a substrate 143*b* at an interface 144*b*. In some embodiments, the interface 144*b* may be substantially planar. Furthermore, in an embodiment, the interface 144*b* may be approximately parallel to the front face 211*b* of the pick body 210*b*. Hence, in an embodiment, the substrate 143*b* may be oriented at a non-parallel angle relative to the working surface 141*b*. Alternatively, the substrate 143*b* may be oriented at a non-parallel angle relative to the front face 211*b* of the pick body 210*b*.

Figure 2C:
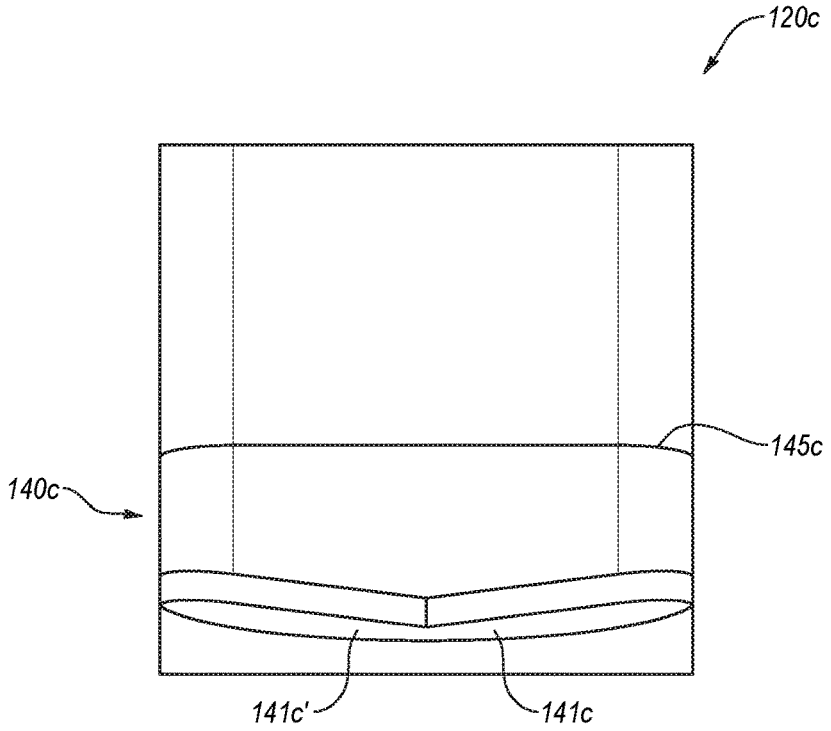
FIG. 2C is a top view of a pick according to another embodiment.

Generally, the side rake angle may be in one or more ranges described above in connection with the back rake angle. Also, as noted above, the pick may include a working surface with multiple side rakes or multiple portions that have different side rake angles. FIG. 2C illustrates a pick 120*c* according to an embodiment, which include a PDC 140*c* with working surfaces 141*c*, 141*c*'. Except as otherwise described herein, the pick 120*c* and its materials, elements, or components may be similar to or the same as any of the picks 120, 120*a*, 120*b* (FIGS. 1A-2B) and their respective materials, elements, and components. For example, the working surfaces 141*c*, 141*c*' may have the same side rake angles (e.g., similar to or the same side rake angles as the working surface 141*b* (FIG. 2B). In an embodiment, side rake angles of formed by the working surfaces 141*c*, 141*c*' may be on opposite sides of the PDC 140*c*.

The picks and/or PDC including side and/or back rake angles may be manufactured in any number of suitable ways. For example, the side rake angle and/or the back rake angle may be angling the working surface of the PDC (e.g., to form an angle relative to a mounting side of the PDC, such as the mounting side 145c). Alternatively or additionally, the rake angle(s) may be produced by mounting the PDC on the pick body in a manner that produces the desired or suitable rake angle(s). Consequently, in an embodiment, the working surface of the PDC may be approximately parallel to the mounting side of the PDC. Furthermore, in some embodiments, the side rake angle and/or back rake angle may be adjusted.

Figure 3:
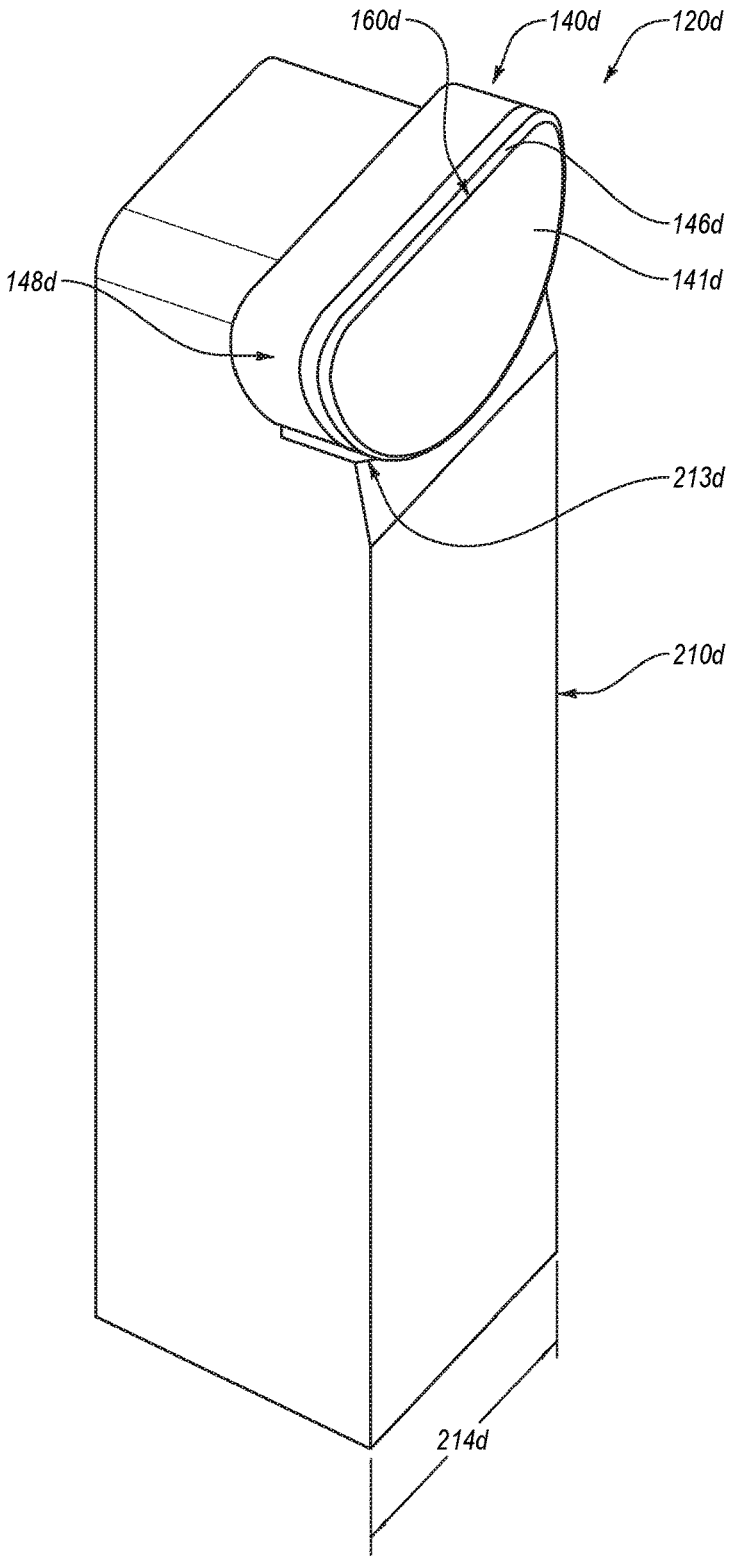
FIG. 3 is an isometric view of a pick according to an embodiment.

As described above, in some embodiments, the PDC attached or mounted on the pick body may have the same or similar width as the width of the pick body. Alternatively, the width of the PDC may be less than the width of the pick body. Moreover, as shown in FIG. 3, in some embodiments, a pick 120*d* may include a PDC 140*d*, which may be wider than a body 210*d* of the pick 120*d*. Except as otherwise described herein, the pick 120*d* and its materials, elements, or components may be similar to or the same as any of the picks 120, 120*a*, 120*b*, 120*c* (FIGS. 1A-2C) and their respective materials, elements, and components. For example, the PDC 140*d* may include a working surface 141*d*, which may be similar to or the same as any of the working surfaces 141, 141*a*, 141*b* (FIGS. 1A-2B). Additionally or alternatively, the PCD 140*d* may include multiple working surfaces that may be similar to the working surfaces 141*c*, 141*c*' of the PDC 140*c* (FIG. 2C).

In an embodiment, the PDC 140*d* may be wider than a width 214*d* of the pick body 210*d*. Accordingly, in an embodiment, the PDC 140*d* may include side portions that extend beyond or past the width 214*d* of the pick body 210*d*. In other words, at least a portion of the PDC 140*d* may be unsupported by the pick body 210*d*. For instance, the PDC 140*d* may include rounded portions 148*d*, which may be at least partially located outside of the pick body 210*d*.

In some embodiments, as described above, the PDC 140*d* may include a chamfer 146*d*. For instance, the edge between the chamfer 146*d* and the working surface 141*d* may form or define a cutting edge 160*d*. As noted above, however, it should be appreciated that the chamfer 146*d* also may cut, shear, grind, or otherwise fail the target road material.

Furthermore, as described above, in some examples, the milling drum may include one or more mounting bases. In particular, in some instances, the mounting bases may be larger than pick bodies, such as the pick body 120*d*. In some embodiments, however, width of the PDC 140*d* may be the same as or similar to the mounting base. In other words, the portions of the PDC 140*d* that extend past the pick body 210*d* may extend over or cover at least some portions of the mounting bases. Hence, the milling drum that includes picks 120*d* may have a greater combined length of cutting edges than a milling drum that includes picks without PDC portions that protrude past the pick bodies.

The PDC 140*d* may also be received into a partial cylindrical pocket or recess 213*d* of the pick body 210*d*. Similar to the recess 213*a* (FIG. 2A), the recess 213*d* may locate the PDC 140*d* relative to the pick body 210*d* (i.e., may position and orient the PDC 140*d*). Furthermore, in an embodiment, the recess 213*d* may restrict movement of the PDC 140*d* (e.g., the recess 213*d* may restrict rotational movement of the PDC 140*d*). As described above, in an embodiment, at least a portion of the PDC 140*d* may be unsupported by the pick body 210*d* and, thus, may be located outside of the recess 213*d*.

In an embodiment, however, the pick body 210*d* may also include extensions (not shown) at the recess 213*d* that extend outward with the PDC 140*d*. The extensions may provide additional support to the portions of the PDC 140*d* that protrude past the width 214*d* of the pick body 210*d*. For example, the extensions may be sized and configured to complement and support the side portions of the PDC 140*d*.

Figure 4:
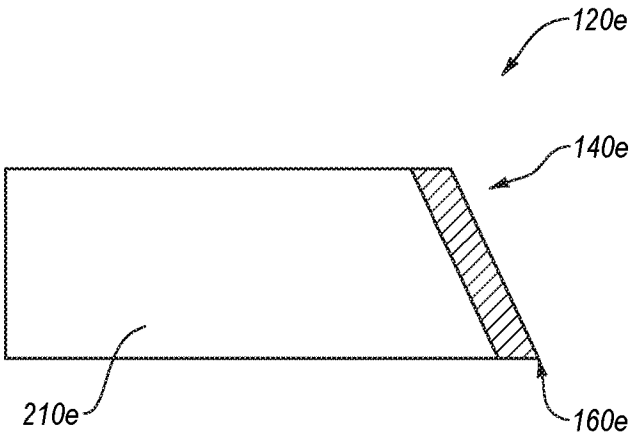
FIG. 4 is a side view of a pick according to yet another embodiment.

FIG. 4 illustrates a pick 120*e* according to one or more embodiments. Except as otherwise described herein, the pick 120*e* and its materials, elements, or components may be similar to or the same as any of the picks 120, 120*a*, 120*b*, 120*c*, 120*d* (FIGS. 1A-3) and their respective materials, elements, and components. For example, the pick 120*e* may include a PDC 140*e* secured to a pick body 210*e*. In some embodiments, the pick 120*e* may have a sharp (i.e., un-chamfered) cutting edge 160*e*. Moreover, in one example, the pick body 210*e* may have no recess, and the PDC 140*e* may be attached to an un-recessed portion of the pick body 210*e*.

Figure 5:
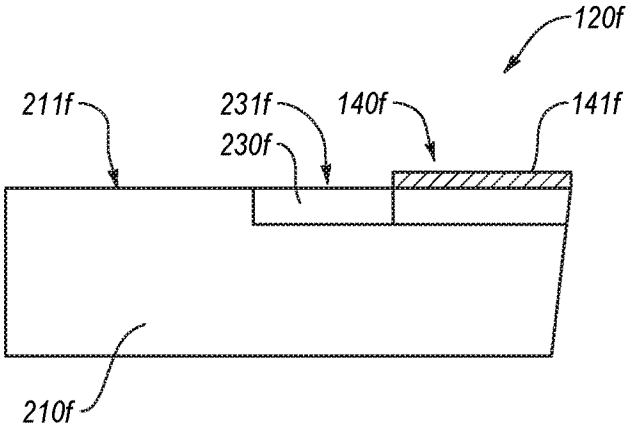
FIG. 5 is a side view of a pick according to still one other embodiment.

FIG. 5 illustrates a pick 120*f* according to at least one embodiment. Except as otherwise described herein, the pick 120*f* and its materials, elements, or components may be similar to or the same as any of the picks 120, 120*a*, 120*b*, 120*c*, 120*d*, 120*e* (FIGS. 1A-4) and their respective materials, elements, and components. For example, the pick 120*f* may include a PDC 140*f* attached to a pick body 210*f*.

Furthermore, the PDC 140*f* may include a working surface 141*f*. As noted above, in an embodiment, the working surface 141*f* may have a zero degree rake angle (or no rake angle) when mounted on the milling drum. For example, the working surface 141*f* may be approximately parallel to a front face 211*f* of the pick body 210*f*. Additionally or alternatively, the working surface 141*f* may be offset from the front face 211*f* of the pick body 210*f*. In other words, the PDC 140*f* may protrude outward from the pick body 210*f* and the front face 211*f* thereof.

In some embodiments, the pick 120*f* may include a shield 230*f* that may be positioned near the PDC 140*f*. In one embodiment, a front face 231*f* of the shield 230*f* may be approximately coplanar with the front face 211*f* of the pick body. Hence, in an embodiment, the front face 231*f* of the shield may be recessed from the working surface 141*f* of the PDC 140*f* (e.g., in a manner that may reduce or minimize contact of the shield 230*f* with the road material during operation of the pick 120*f*.

Generally, the shield 230*f* may include any suitable material. In an embodiment, the shield 230*f* may include material (s) that may be harder and/or more wear resistant than the material(s) of the pick body 210*f*. For example, the shield 230*f* may include carbide, polycrystalline diamond, or other suitable material that may protect the portion of the pick body 210*f* located behind the shield 230*f*.

Figure 6:
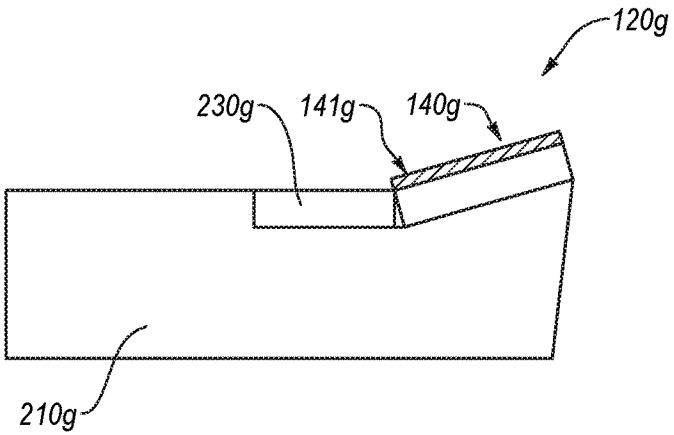
FIG. 6 is a side view of a pick according to one or more embodiments.

Additionally, in an embodiment, as shown in FIG. 6, as discussed above, a pick 120*g* may have a positive back rake angle. Except as otherwise described herein, the pick 120*g* and its materials, elements, or components may be similar to or the same as any of the picks 120, 120*a*, 120*b*, 120*c*, 120*d*, 120*e*, 120*f* (FIGS. 1A-5) and their respective materials, elements, and components. For example, the pick 120*g* may include a PDC 140*g* that has a working surface 141*g*, which may be oriented at a positive back rake angle during operation of the pick 120*g*. In an embodiment, a pick body 210*g* of the pick 120*g* may orient the PDC 140*g* in a manner that the working surface 141*g* forms a positive back rake angle during operation.

Furthermore, in some embodiments, the pick 120*g* may include a shield 230*g*, which may be similar to the shield 230*f* (FIG. 5). For instance, the shield 230*g* may be positioned near and may abut the PDC 140*g*. As such, the shield 230*g* may shield or protect from wear a portion the pick body 230*g* that is near the PDC 140*g*.

Figure 7:
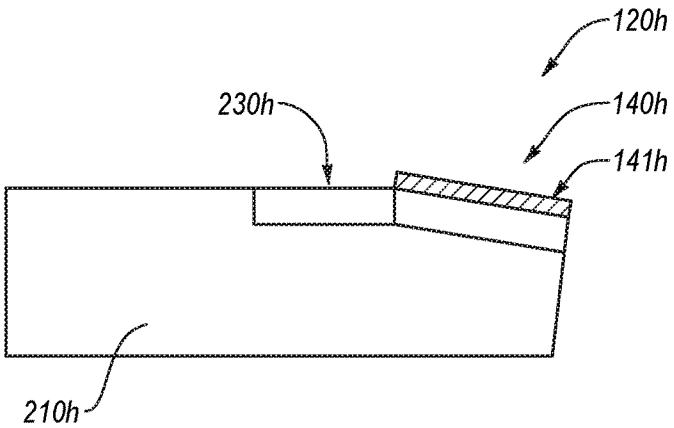
FIG. 7 is a side view of a pick according to an embodiment.

As mentioned above, the pick may have a working surface that has a positive back rake angle. FIG. 7, for example, illustrates a pick 120*h* that includes a PDC 140*h* attached to a pick body 210*h*. Except as otherwise described herein, the pick 120*h* and its materials, elements, or components may be similar to or the same as any of the picks 120, 120*a*, 120*b*, 120*c*, 120*d*, 120*e*, 120*f*, 120*g* (FIGS. 1A-6) and their respective materials, elements, and components. For instance, the pick 120*h* may include a shield 230*h*, which may be similar to or the same as the shield 230*f* (FIG. 5). In an embodiment, the PDC 140*h* may include a working surface 141*h*, which may form a negative back rake.

Figure 8:
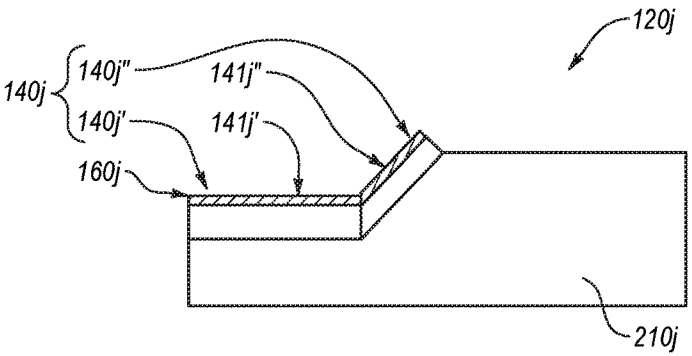
FIG. 8 is a side view of a pick according to yet another embodiment.

FIG. 8 illustrates a pick 120*j* according to an embodiment. Except as otherwise described herein, the pick 120*j* and its materials, elements, or components may be similar to or the same as any of the picks 120, 120*a*, 120*b*, 120*c*, 120*d*, 120*e*, 120*f*, 120*g*, 120*h* (FIGS. 1A-7) and their respective materials, elements, and components. For example, the pick 120*j* may include one or more PDCs 140*j* attached to a pick body 210*j*. More specifically, in an embodiment, the pick 120*j* includes a first PDC 140*j*' and a second PDC 140*j*". In one example, the first and second PDCs 140*j*', 140*j*" may be oriented relative to each other at a non-parallel angle. For instance, the first and second PDCs 140*j*', 140*j*" may form an obtuse angle therebetween.

In an embodiment, the first PDC 140*j*' may include a cutting edge 160*j*. Furthermore, the first and second PDCs 140*j*', 140*j*" may include respective working faces 141*j*', 141*j*". More specifically, in an embodiment, the working faces 141*j*', 141*j*" may fail road material and/or deflect failed road material away from the pick 120*j*. Additionally or alternatively, the second PDC 140*j*" may protect at least a portion of the pick body 120*j*. For example, the second PDC 140*j*" may protect a portion of the pick body 210*j* near the first PDC 140*j*'.

Figure 9:
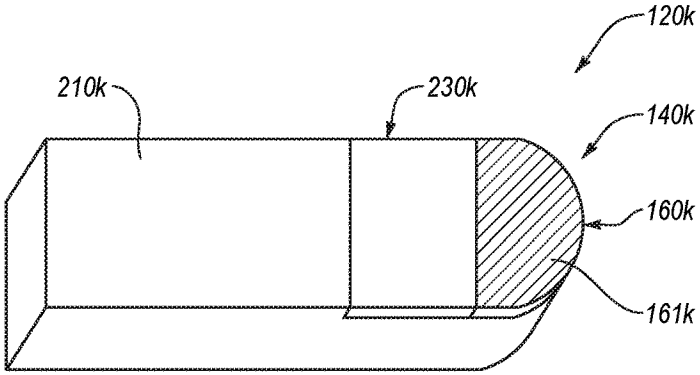
FIG. 9 is an isometric view of a pick according to at least one other embodiment.

While at least one of the above described embodiments includes a linear cutting edge, it should be appreciated that this disclosure is not so limited. For instance, FIG. 9 illustrates a pick 120*k* that may have a non-linear cutting edge 160*k*. Except as otherwise described herein, the pick 120*k* and its materials, elements, or components may be similar to or the same as any of the picks 120, 120*a*, 120*b*, 120*c*, 120*d*, 120*e*, 120*f*, 120*g*, 120*h*, 120*j* (FIGS. 1A-8) and their respective materials, elements, and components. For example, the pick 120*k* may include an approximately semicircular cutting edge 160*k*.

In an embodiment, the cutting edge 160*k* may be at least partially formed by a PDC 140*k*, which may be secured to a pick body 210*k*. Furthermore, the cutting edge 160*k* may at least partially define the perimeter of the PDC 140*k*. Hence, in at least one embodiment, the PDC 140*k* may have a semicircular shape that may protrude away from the pick body 210*k*.

In some instances, the pick 120*k* may include a shield 230*k*, which may be similar to or the same as the shield 230*f* (FIG. 5). Moreover, in one example, the shield 230*k* may abut the PDC 140*k*. For example, the PDC 140*k* and the shield 230*k* may have approximately straight sides that may be positioned next to each other and/or may abut each other on the pick body 230*k* (i.e., a bottom side of the PDC 140*k* and a top side of the shield 230*k*).

Figure 10:
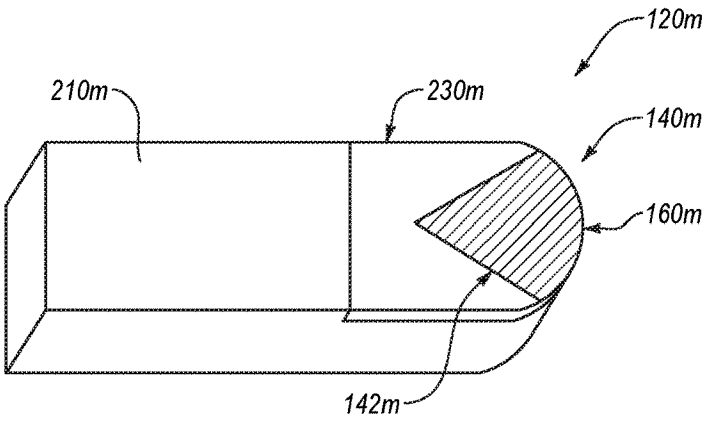
FIG. 10 is an isometric view of a pick according to at least one embodiment.

Alternatively, the bottom side of the PDC may be non-linear and/or not straight. For instance, FIG. 10 illustrates a pick 120*m* that includes a PDC 140*m* attached to a pick body 210*m*. Except as otherwise described herein, the pick 120*m* and its materials, elements, or components may be similar to or the same as any of the picks 120, 120*a*, 120*b*, 120*c*, 120*d*, 120*e*, 120*f*, 120*g*, 120*h*, 120*j*, 120*k* (FIGS. 1A-9) and their respective materials, elements, and components. For example, the pick 120*m* may include a rounded cutting edge 160*m*, at least a portion of which may be on the PDC 140*m*.

In an embodiment, a bottom side 142*m* of the PDC 140*m* may be nonlinear or may include multiple linear segments. In an embodiment, the pick 120*m* may include a shield 230*m* that may be secured to the pick body 230*m*. Furthermore, the shield 230*m* may abut at least a portion of the bottom side 142*m* of the PDC 140*m*. Accordingly, in at least one embodiment, the shield 230*m* may have a nonlinear top side that may abut or may be positioned near the bottom side 230*m* of the PDC 140*m*. For instance, the top side of the shield 230*m* may have a shape and side that may be complementary to the shape and size of the bottom side 142*m* of the PDC 140*m*, such that at least a portion of the PDC 140*m* may fit inside the shield 230*m* and/or at least a portion of the shield 230*m* may fit into the PDC 140*m*. In one or more embodiments, the bottom side 142*m* of the PDC 140*m* may have a convex shape (e.g., V-shaped convex), and the top side of the shield 230*m* may have a corresponding concave shape, which may receive the convex shape of the bottom side 142*m*.

Figure 11:
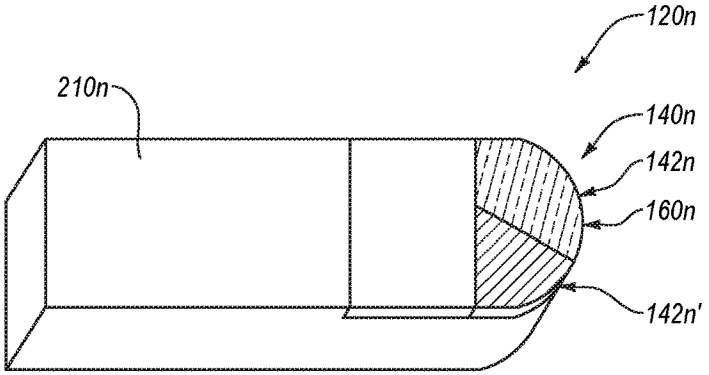
FIG. 11 is an isometric view of a pick according to still another embodiment.

In at least one embodiment, the PDC may include multiple materials. FIG. 11, for instance, illustrates a pick 120*n* that includes a PDC 140*n* attached to a pick body 210*n*. Except as otherwise described herein, the pick 120*n* and its materials, elements, or components may be similar to or the same as any of the picks 120, 120*a*, 120*b*, 120*c*, 120*d*, 120*e*, 120*f*, 120*g*, 120*h*, 120*j*, 120*k*, 120*m* (FIGS. 1A-10) and their respective materials, elements, and components. In an embodiment, the PDC 140*n* may include two PCD components 142*n*, 142*n*' bonded to a substrate. Collectively, the PCD components 142*n*, 142*n*' may form a cutting edge 160*n*. In an embodiment, the two PCD components 142*n*, 142*n*' may be formed from different types of PCD materials that may exhibit different wear resistances and/or thermal stabilities.

Figure 12:
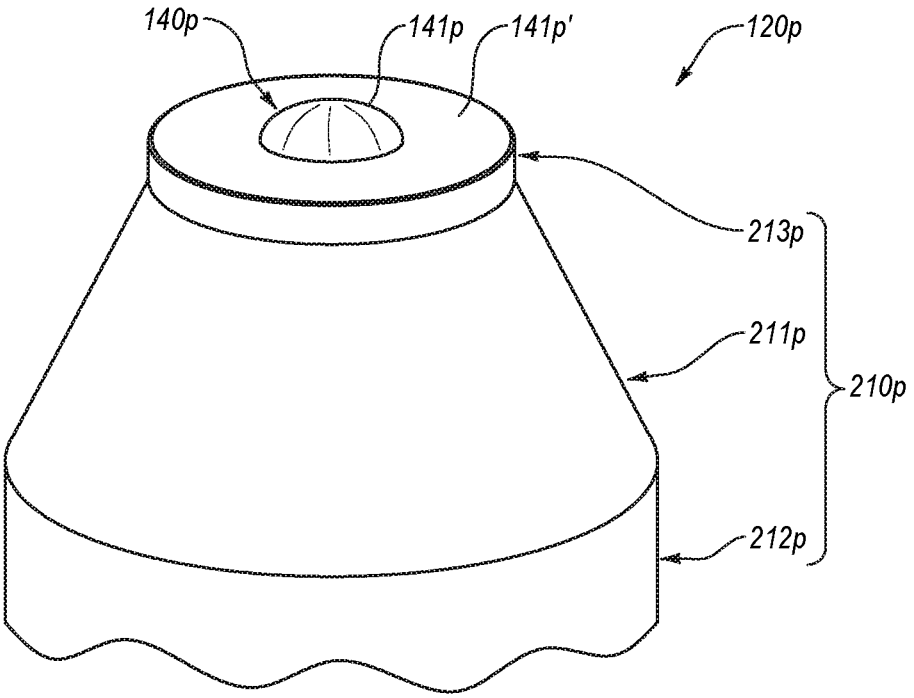
FIG. 12 is an isometric view of a pick according to one or more other embodiments.

While in one or more embodiments the pick body may have an approximately rectangular or square cross-sectional shape, this disclosure is not so limited. FIG. 12, for example, illustrates a portion of a pick 120*p* that includes a PDC 140*p*. Except as otherwise described herein, the pick 120*p* and its materials, elements, or components may be similar to or the same as any of the picks 120, 120*a*, 120*b*, 120*c*, 120*d*, 120*e*, 120*f*, 120*g*, 120*h*, 120*j*, 120*k*, 120*m*, 120*n* (FIGS. 1A-11) and their respective materials, elements, and components. For example, the pick 120*p* may include a pick body 210*p* that has an approximately circular cross-sectional shape.

For instance, the pick body 210*p* may include a conical portion 211*p* and a first cylindrical portion 212*p* connected to or integrated with the conical portion 211*p*. In an embodiment, the first cylindrical portion 212*p* may extend from a major diameter of the conical portion 211*p*. In at least one embodiment, the pick body 210*p* may include a second cylindrical portion 213*p*. For example, the second cylindrical portion 213*p* may extend from a minor diameter of the conical portion 211*p*.

In an embodiment, the PDC 140*p* may include a working surface 141*p*, which may include polycrystalline diamond. For instance, the working surface 141*p* may have a semi-spherical or dome shape that extends or protrudes from a second cylindrical portion 213*p*. In one example, the second cylindrical portion 213*p* may include an approximately planar working surface 141*p*', which may engage the target road material. Hence, in an embodiment, the working surface 141*p* of the PDC 140*p* may protrude above the working surface 141*p*'.

The pick body 210*p* may include any number of suitable materials and combinations of materials, which may vary from one embodiment to the next. In at least one embodiment, the pick body 210*p* includes cemented carbide material. Thus, for example, the second cylindrical portion 213*p* of the pick body 210*p* may form a substrate. Moreover, in an example, the PDC 140*p* may include polycrystalline diamond table that may be bonded to the second cylindrical portion 213*p* of the pick body 210*p*.

In at least one embodiment, the domed working surface 141*p* may facilitate rotation of the pick 120*p* during operation thereof (i.e., the pick 120*p* may rotatably fail target road material). For example, the PDC 140*p* may be rotatably mounted to a pick body 210*p* in a manner that allows the PDC 140*p* to rotate during operation of the pick 120*p* (e.g., when the working surface 141*p* engages the target material). In an embodiment, the second cylindrical portion 213*p* of the pick body 210*p* may rotate together with the working surface 141*p* relative to the remaining portions of the pick body 210*p*, such as relative to the conical portion 211*p*. Rotating the working surface 141*p* during operation of the pick 120 may extend the useful life of the pick 120*p* (e.g., by distributing the wear around the entire working surface 141*p*).

Figure 13A:
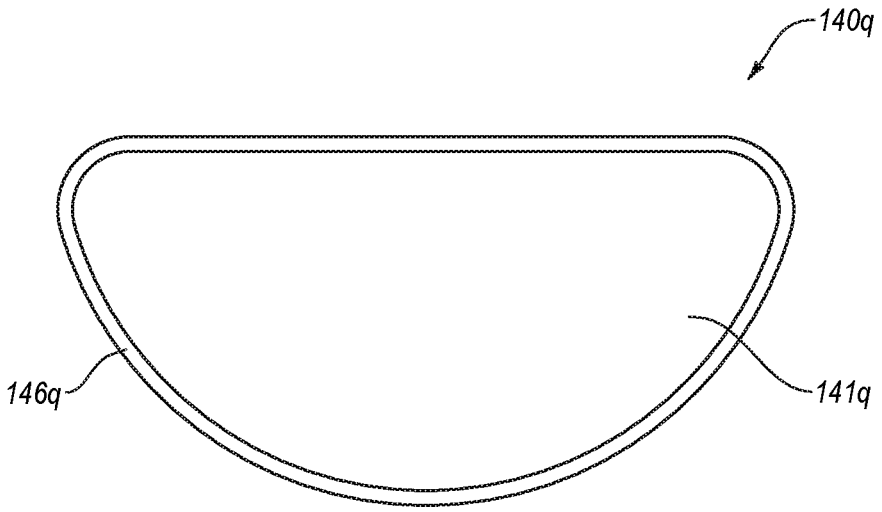
FIG. 13A is a top view of a PDC according to an embodiment.
Figure 13B:
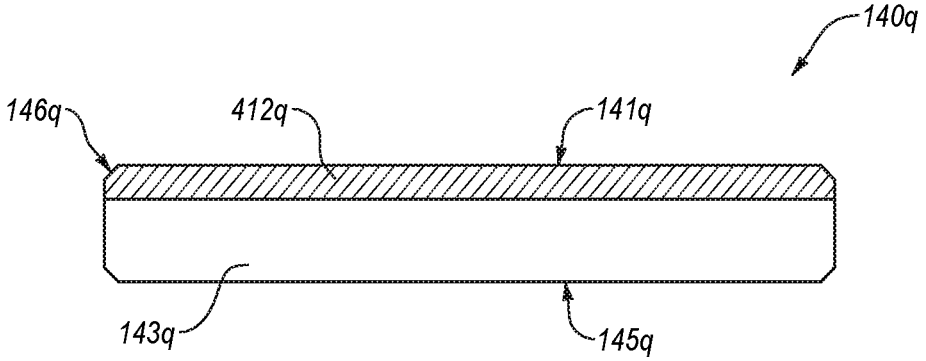
FIG. 13B is a cross-sectional view of the PDC of FIG. 13A.

FIGS. 13A and 13B illustrate a PDC 140*q* according to one embodiment. Except as otherwise described herein, the PDC 140*q* and its materials, elements, or components may be similar to or the same as any of the PDCs 140, 140*a*, 140*b*, 140*c*, 140*d*, 140*e*, 140*f*, 140*g*, 140*h*, 140*j*, 140*k*, 140*m*, 140*n*, 140*p* (FIGS. 1A-12) and their respective materials, elements, and components. As such, the PDC 140*q* may be included in any of the picks described herein.

For instance, the PDC 140*q* includes a PCD table 142*q* (i.e., polycrystalline diamond table) bonded to a substrate 143*q*. In an embodiment, the substrate 143*q* may be a cobalt-cemented tungsten carbide substrate. Also, in at least one embodiment, the PCD table 142*q* includes a substantially planar working surface 141*q*. The substrate 143*q* of the PDC 140*q* may include a planar back surface or mounting side 145*q*.

As described above, in some instances, the working surface 141*q* may be approximately parallel to the surface of the mounting side 145*q* of the PDC 140*q*. Hence, to produce a desired or suitable back rake and/or side rake angles, the PDC 140*q* may be oriented relative to the pick body by the mounting thereof (e.g., by the recess orienting the PDC). Alternatively, the working surface 141*q* may be non-parallel to the surface of the mounting side 145*q*. Accordingly, in an embodiment, the recess in the pick body may be parallel to the front face of the pick body (or relative to the imaginary longitudinal line), and the back rake and/or side rake angles may be produced by the non-parallel orientation of the working surface 141*q* relative to the mounting side 145*q*.

In some instances, the PDC 140*q* may include a chamfer 146*q*. In particular, for example, the chamfer 146*q* may extend between the working surface 141*q* and one or more side surfaces of the PDC 140*q*. Also, in an embodiment, the chamfer 146*q* may surround the entire perimeter or periphery of the working surface 141*q*. Alternatively, however, the chamfer 146*q* may extend only about a portion of the perimeter of the working surface 141*q*.

Generally, the chamfer 146*q* may have any suitable size (whether an absolute size or as a percentage of one or more dimensions of the PDC 140*q*), which may vary from one embodiment to the next. For example, the chamfer 146*q* may be about 0.015 inch to about 0.050 inch. Furthermore, the chamfer 146*q* may form any suitable angle relative to the working surface 141*q* and/or relative to the side surfaces of the PDC 140*q*. For instance, the chamfer 146*q* may form an angle of about 30 to about 55 degrees relative to the working surface 146*q* (e.g., the chamfer 146*q* may be at about 45 degrees relative to the working surface 141*q*). However, in other embodiments, a variety of different chamfer heights and angles may be utilized. Moreover, in at least one embodiment, the PDC 140*q* may include a radius or a fillet that extends between the working surface 141*q* and one or more sides of the PDC 140*q*.

As noted above, the PDC 140*q* may have an approximately semicircular shape that may define the perimeter of the working surface 141*q*. For example, a PDC having a circular cross-sectional shape (i.e., an approximately cylindrical shape) may be cut into two portions or halves, one or both of which may be used to manufacture the PDC 140*q*. In an embodiment, an electrical discharge machining (e.g., wire EDM) may be used to cut the PDC 140*q* into two halves. Alternatively, the PDC 140*q* may be formed as with a semicircular cross-sectional shape.

In an embodiment, the PCD table includes a plurality of bonded diamond grains defining a plurality of interstitial regions. A metal-solvent catalyst may occupy the plurality of interstitial regions. The plurality of diamond grains and the metal-solvent catalyst collectively may exhibit a coercivity of about 115 Oersteds ("Oe") or more and a specific magnetic saturation of about 15 Gauss·cm$^3$/grams ("G·cm$^3$/g") or less. Additionally, in at least one embodiment, the PCD table may include a plurality of diamond grains defining a plurality of interstitial regions. A metal-solvent catalyst may occupy the plurality of interstitial regions. The plurality of diamond grains and the metal-solvent catalyst collectively may exhibit a specific magnetic saturation of about 15 G·cm$^3$/g or less. The plurality of diamond grains and the metal-solvent catalyst may define a volume of at least about 0.050 cm$^3$. Additional description of embodiments for the above described PCD table is provided in U.S. Pat. No. 7,866,418, which is incorporated herein, in its entirety, by this reference.

In at least one embodiment, the PDC 140*q* may include a preformed PCD volume or PCD table, as described in more detail in U.S. Pat. No. 8,236,074, which is incorporated herein in its entirety by this reference. For example, the PCD table that may be bonded to the substrate 143*q* by a method that includes providing the substrate, the preformed PCD volume, and a braze material and at least partially surrounding the substrate, the preformed PCD volume or PCD table, and a braze material within an enclosure. Also, the enclosure may be sealed in an inert environment. Furthermore, the enclosure may be exposed to a pressure of at least about 6 GPa and, optionally, the braze material may be at least partially melted.

In yet another embodiment, a PDC 140*q* may include a substrate 143*q* and a preformed PCD table that may include bonded diamond grains defining a plurality of interstitial regions, and which may be bonded to the substrate, as described in further detail in U.S. patent application Ser. No. 13/070,636, which is incorporated herein, in its entirety, by this reference. For instance, the preformed PCD table may further include an upper surface, a back surface bonded to the substrate, and at least one lateral surface extending between the upper surface and the back surface. A region may extend inwardly from the upper surface and the at least one lateral surface. The region may include at least a residual amount of at least one interstitial constituent disposed in at least a portion of the interstitial regions thereof. The at least one interstitial constituent may include at least one metal carbonate and/or at least one metal oxide. Additionally, a bonding region may be placed adjacent to the substrate and extending inwardly from the back surface. The bonding region may include a metallic infiltrant and a residual amount of the at least one interstitial constituent disposed in at least a portion of the interstitial regions thereof.

In another embodiment, the PCD table of the PCD 140*q* may include a plurality of diamond grains exhibiting diamond-to-diamond bonding therebetween and defining a plurality of interstitial regions as described in more detail in U.S. patent application Ser. No. 13/027,954, which is incorporated herein, in its entirety, by this reference. For instance, the PCD table may include at least one low-carbon-solubility material disposed in at least a portion of the plurality of interstitial regions. The at least one low-carbon-solubility material may exhibit a melting temperature of about 100° C. or less and a bulk modulus at 20° C. of less than about 150 GPa.

In an additional or alternative embodiment, the PCD table of the PCD 140*q* may include a plurality of bonded-together diamond grains defining a plurality of interstitial regions as described in more detail in U.S. patent application Ser. No. 13/100,388, which is incorporated herein, in its entirety, by this reference. For instance, the PCD table may include aluminum carbide disposed in at least a portion of the plurality of interstitial regions. Moreover, in an embodiment, the PCD table may include a plurality of bonded diamond grains that may exhibit an average grain size of about 40 μm or less.

In at least one embodiment, the preformed PCD table may include at least a portion of the interstitial regions of the first region including an infiltrant disposed therein, as described in more detail in U.S. patent application Ser. No. 12/961,787, which is incorporated herein, in its entirety, by this reference. In some embodiments, the preformed PCD table may also include a second region adjacent to the first region and extending inwardly from the exterior working surface to a depth of at least about 700 μm. In some instances, the interstitial regions of the second region may be substantially free of the infiltrant. In one example, the preformed PCD table may have a nonplanar interface located between the first and second regions.

In an embodiment, the PCD table may include a plurality of bonded diamond grains defining a plurality of interstitial regions and at least a portion of the plurality of interstitial regions may include a cobalt-based alloy disposed therein as described in more detail in U.S. application Ser. Nos. 13/275,372 and 13/648,913, each of which is incorporated herein, in its entirety, by this reference. In some examples, a cobalt-based alloy may include at least one eutectic forming alloying element in an amount at or near a eutectic composition for an alloy system of cobalt and the at least one eutectic forming alloying element.

In some embodiments, the PCD table of the PDC 140*q* may include an interfacial surface bonded to a cemented carbide substrate and an upper surface and an infiltrant, which may be disposed in at least a portion of a plurality of interstitial regions as described in more detail in U.S. patent application Ser. No. 13/795,027, which is incorporated herein, in its entirety, by this reference. For instance, the infiltrant may include an alloy comprising at least one of nickel or cobalt, at least one of carbon, silicon, boron, phosphorus, cerium, tantalum, titanium, niobium, molybdenum, antimony, tin, or carbides thereof, and at least one of magnesium, lithium, tin, silver, copper, nickel, zinc, germanium, gallium, antimony, bismuth, or gadolinium.

Figure 14A:
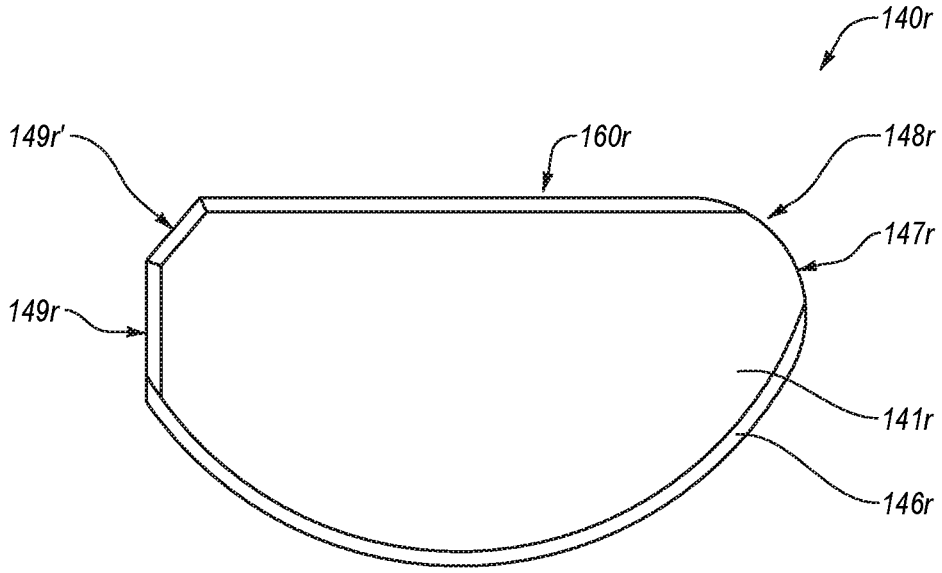
FIG. 14A is a top view of a PDC according to another embodiment.
Figure 14B:
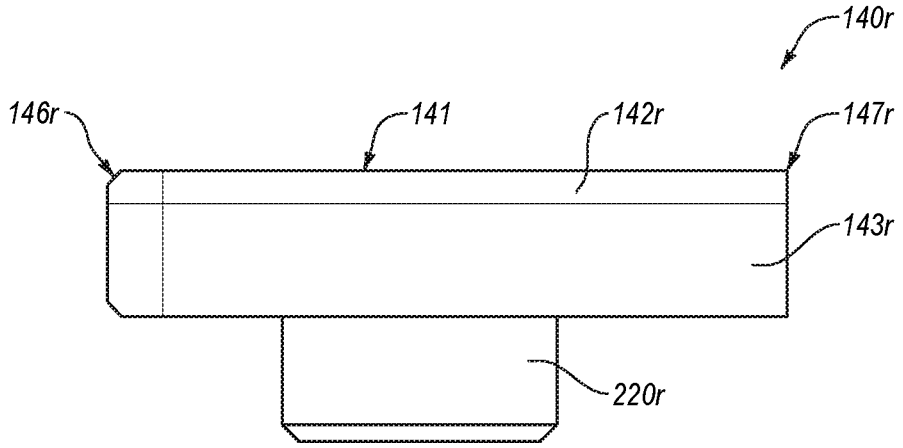
FIG. 14B is a side view of the PDC of FIG. 14A.

As mentioned above, in some instances, at least a portion of the perimeter defining the working surface of the PDC may be un-chamfered. For example, FIGS. 14A and 14B illustrate a PDC 140*r* that includes a chamfer 146*r* that extends only about a portion of the perimeter of a working surface 141*r*. Except as otherwise described herein, the PDC 140*r* and its materials, elements, or components may be similar to or the same as any of the PDCs 140, 140*a*, 140*b*, 140*c*, 140*d*, 140*e*, 140*f*, 140*g*, 140*h*, 140*j*, 140*k*, 140*m*, 140*n*, 140*p*, 140*q* (FIGS. 1A-13B) and their respective materials, elements, and components. Thus, the PDC 140*r* may be included in any of the picks described herein. For example, the PDC 140*r* may include a PCD table 142*r*, which may have the working surface 141*r*, and which may be bonded to a substrate 143*r*.

In an embodiment, the PDC 140*r* may include an un-chamfered portion 147*r*. For instance, the chamfer 146*r* may extend about the perimeter of the working surface 141*r* in a manner that maintains the un-chamfered portion 147*r* without a chamfer thereon. In one example, the chamfer 146*r* may extend from a first end of the un-chamfered portion 147*r*, surround the perimeter of the working surface 141*r* (except the un-chamfered portion 147*r*), and terminate at a second, opposing end of the un-chamfered portion 147*r*.

As mentioned above, in some embodiment, the PDC may have an approximately semicircular shape. Moreover, the PDC may include one or more rounded portions. For instance, the PDC 140*r* includes a rounded portion 148*r*. In at least one embodiment, the PDC 140*r* may include linear side portions 149*r*, 149*r*'. The each of linear side portions 149*r*, 149*r*' may be approximately straight or linear. Furthermore, in an embodiment, the linear side portions 149*r*, 149*r*' may truncate or limit width of the PDC 140*r*.

In an embodiment, the linear side portion 149*r* may extend approximately perpendicular to a cutting edge 160*r* of the PDC 140*r*. In one embodiment, the linear side portion 149*r*' may form a bevel between the cutting edge 160*r* and the linear side portion 149*r*. For instance, the linear side portion 149*r*' may extend between the linear side portion 149*r* and the cutting edge 160*r* at approximately 45 degrees relative thereto.

In some embodiments, the chamfer 146*r* may extend over the linear side portions 149*r*, 149*r*'. Additionally or alternatively, one or both of the linear side portions 149*r*, 149*r*' may engage the target road material. Consequently, the linear side portions 149*r* and/or 149*r*' may cut, grind, scrape, shear, or otherwise fail the road material.

In at least one embodiment, the PDC 140*r* may include a stud or post 220*r*, which may attached to or incorporated with the substrate 143*r*. The post 220*r* may include any number of suitable materials, such as steel, a cemented carbide material, or another suitable material. In an embodiment, the post 220*r* may provide additional strength to an attachment between the PDC 140*r* and the pick body. For instance, the post 220*r* may be press-fit into a corresponding opening in the pick body. Also, the post 220*r* may position or locate the PDC 140*r* relative to the pick body.

Figure 15:
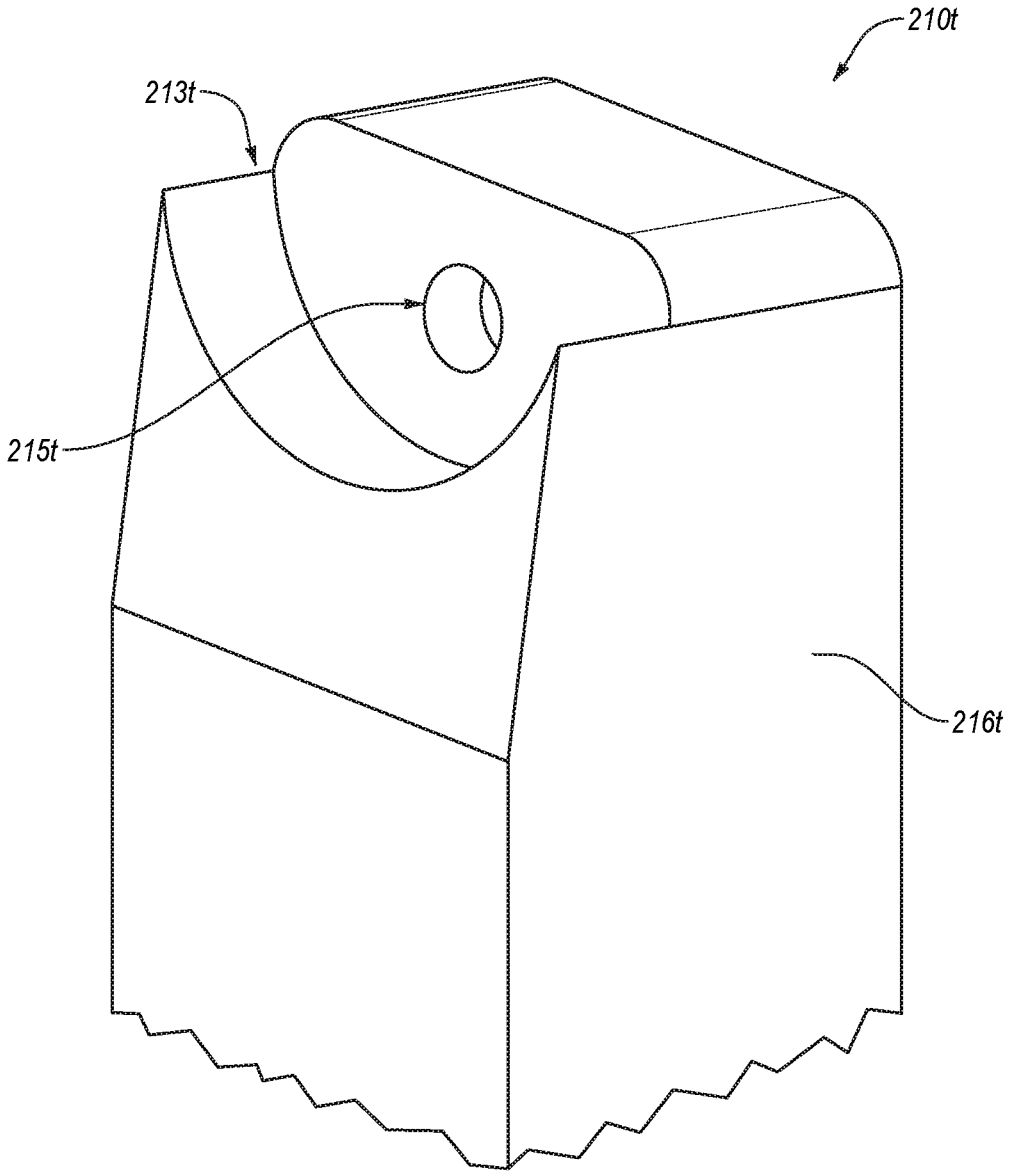
FIG. 15 is an isometric view of a pick body according to an embodiment.

For example, FIG. 15 illustrates a pick body 210*t* that may secure a PDC according to one or more embodiments. Except as described herein, the pick body 210*t* and its materials, elements, or components, may be similar to or the same as any of pick bodies 210*a*, 210*b*, 210*c*, 210*d*, 210*e*, 210*f*, 210*g*, 210*h*, 210*j*, 210*k*, 210*m*, 210*n*, 210*p* (FIGS. 2A-?) and their respective materials, elements, and components. For example, the pick body 210*t* may include a recess 213*t*, which may accommodate a PDC.

Also, in some instances, the pick body 210*t* may include an opening 215*t*, which may accept a post of PDC. In some instances, the opening 215*t* may locate the PDC (e.g., providing positional location) relative to one or more faces of the pick body 210*t*. For example, the opening 215*t* may be positioned at a predetermined location from a first side surface 216*t* of the pick body 210*t*. Accordingly, in an embodiment, positioning the post of the PDC within the opening 215*t* may position the PDC at a predetermined location relative to the first side surface 216*t* of the pick body 210*t*.

Furthermore, in an embodiment, the PDC may be attached to the pick body 210*t* at least in part through a connection between the post of the PDC and the opening 215*t* in the pick body 210*t*. For example, the post and/or other portions of the PDC may be brazed to the pick body 210*t*. Optionally, (e.g., in combination with brazing the PDC and/or the post to the pick body 210*t* or without such brazing), the post may be press-fit into the opening 215*t* in the pick body 210*t*. It should be appreciated that there are a variety of other methods and mechanisms for attaching a PDC to the pick body, such as to the pick body 210*t*.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A pick, comprising:

a pick body; and at least one polycrystalline diamond compact ("PDC") attached to the pick body, the at least one PDC including:

a curved bottom edge;

a top cutting edge generally opposite the curved bottom edge, wherein at least a portion of the top cutting edge is substantially straight; and at least one substantially planar working surface extending between the curved bottom edge and the top cutting edge.

2. The pick of claim 1 wherein:

the pick body includes a pocket that receives the at least one PDC; and the at least one PDC includes a bottom surface that has a complementary geometry to a geometry of the pocket.

3. The pick of claim 1 wherein the at least one PDC includes a plurality of PDCs.

4. The pick of claim 1 wherein the at least one substantially planar working surface includes a back rake angle.

5. The pick of claim 4 wherein the back rake angle is about 30 degrees positive back rake angle to about 30 degrees negative back rake angle.

6. The pick of claim 4 wherein the back rake angle is about 6 degrees to about 14 degrees.

7. The pick of claim 1 wherein the at least one substantially planar working surface includes one or more side rake angles.

8. The pick of claim 1 wherein the at least one substantially planar working surface exhibits a truncated circular geometry.

9. The pick of claim 1 wherein the at least one substantially planar working surface exhibits a substantially semicircular geometry.

10. The pick of claim 1 wherein:

the pick body includes an upper surface; and the curved bottom edge is convexly curved and the top cutting edge is substantially parallel with an upper surface of the pick body.

11. The pick of claim 1 wherein the curved bottom edge defines part of a circle.

12. The pick of claim 1 wherein a portion of the top cutting edge is rounded.

13. The pick of claim 1, further comprising a shield exhibiting a different composition from and attached to the pick body, the shield positioned near the at least one PDC.

14. The pick of claim 13 wherein the shield includes a top side that is nonlinear, wherein the curved bottom edge of the at least one PDC and the top side of the shield have complementary shapes.

15. The pick of claim 1 wherein the at least one PDC includes a substrate bonded to a polycrystalline diamond table.

16. The pick of claim 1 wherein:

the pick body has a first width;

the at least one PDC has a second width that is greater than the first width; and a portion of the at least one PDC is unsupported by the pick body.

17. A pick for a road-removal system, the pick comprising:

a pick body including an end region;

a polycrystalline diamond compact ("PDC") attached to the end region of the pick body, the PDC including:

a curved bottom edge;

a top cutting edge generally opposite the curved bottom edge, wherein at least a portion of the top cutting edge is substantially straight; and a substantially planar working surface extending between the curved bottom edge and the top cutting edge; and a shield having a different composition from and attached to the pick body, the shield positioned near the PDC.

18. The pick of claim 17 wherein:

the substantially planar working surface has a negative back rake angle;

the substantially planar working surface exhibits a truncated circular geometry or a substantially semicircular geometry; and the pick body defines a pocket that receives the PDC, wherein the curved bottom edge of the PDC has a complementary geometry to a geometry of the pocket.

* * * * *